US009720364B2

(12) United States Patent
Kogure et al.

(10) Patent No.: US 9,720,364 B2
(45) Date of Patent: Aug. 1, 2017

(54) IMAGE FORMING APPARATUS

(71) Applicants: Seiichi Kogure, Kanagawa (JP); Naohiro Kumagai, Kanagawa (JP); Junpei Fujita, Kanagawa (JP); Kazuki Yogosawa, Kanagawa (JP); Tatsuya Ohsugi, Kanagawa (JP); Kenji Sugiura, Kanagawa (JP); Yuuji Wada, Kanagawa (JP); Takehide Mizutani, Tokyo (JP); Ryo Hasegawa, Kanagawa (JP)

(72) Inventors: Seiichi Kogure, Kanagawa (JP); Naohiro Kumagai, Kanagawa (JP); Junpei Fujita, Kanagawa (JP); Kazuki Yogosawa, Kanagawa (JP); Tatsuya Ohsugi, Kanagawa (JP); Kenji Sugiura, Kanagawa (JP); Yuuji Wada, Kanagawa (JP); Takehide Mizutani, Tokyo (JP); Ryo Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/966,398

(22) Filed: Dec. 11, 2015

(65) Prior Publication Data

US 2016/0170363 A1 Jun. 16, 2016

(30) Foreign Application Priority Data

Dec. 12, 2014 (JP) ..... 2014-252166
Dec. 15, 2014 (JP) ..... 2014-253063
Oct. 9, 2015 (JP) ..... 2015-201363

(51) Int. Cl.
*G03G 15/00* (2006.01)
*G03G 15/16* (2006.01)

(52) U.S. Cl.
CPC ..... *G03G 15/6529* (2013.01); *G03G 15/6558* (2013.01); *G03G 15/1605* (2013.01); *G03G 2215/0129* (2013.01)

(58) Field of Classification Search
CPC ..... G03G 15/65; G03G 15/6558; G03G 15/6529; G03G 15/1605
See application file for complete search history.

(56) References Cited

U.S. PATENT DOCUMENTS

2009/0279927 A1 11/2009 Fujita
2010/0061777 A1* 3/2010 Matsumoto ..... G03G 15/161 399/316

(Continued)

FOREIGN PATENT DOCUMENTS

JP 2000-172083 6/2000
JP 2008-134387 6/2008

(Continued)

OTHER PUBLICATIONS

U.S. Appl. No. 14/742,730, filed Jun. 18, 2015.
U.S. Appl. No. 14/802,374, filed Jul. 17, 2015.

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

An image forming apparatus includes an image bearer having an image bearing face to bear an image thereon; a transferer disposed opposing the image bearer, to transfer the image from the image bearing face onto a recording medium at a transfer section between the transferer and the image bearer; a first guide disposed upstream from the transfer section in a direction of delivery of the recording medium, to guide the recording medium to the transfer section; and a second guide upstream from the first guide and spaced away from the first guide, to guide the recording (Continued)

medium to the transfer section. Each of the first guide and the second guide extends in a lateral direction perpendicular to the direction of delivery. A leading end of the second guide in the direction of delivery is inclined from one end to the other end of the second guide in the lateral direction.

31 Claims, 20 Drawing Sheets

(56) References Cited

U.S. PATENT DOCUMENTS

| | | | | |
|---|---|---|---|---|
| 2010/0067952 | A1 | 3/2010 | Fujita et al. | |
| 2014/0334847 | A1 | 11/2014 | Takahashi et al. | |
| 2015/0309449 | A1* | 10/2015 | Kakehi ..... | G03G 15/1615 399/388 |

FOREIGN PATENT DOCUMENTS

| | | |
|---|---|---|
| JP | 2011-064823 | 3/2011 |
| JP | 2012-103527 | 5/2012 |

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application Nos. 2014-252166, filed on Dec. 12, 2014, 2014-253063, filed on Dec. 15, 2014, and 2015-201363, filed on Oct. 9, 2015, in the Japan Patent Office, the entire disclosure of each of which is incorporated by reference herein.

BACKGROUND

Technical Field

Aspects of this disclosure relate to an image forming apparatus.

Related Art

In an electrophotographic image forming apparatus, a transfer device includes, for example, a belt-type image bearer to bear an image, a transfer member disposed opposing the image bearer, and a transfer section to transfer the image from image bearer onto a recording medium delivered. Such an image forming apparatus may include a guide unit upstream from a transfer nip in a delivery direction of the recording medium, to guide entry of a recording medium into the transfer nip.

SUMMARY

In an aspect of this disclosure, there is provided an image forming apparatus that includes an image bearer, a transferer, a first guide, and a second guide. The image bearer has an image bearing face to bear an image thereon. The transferer is disposed opposing the image bearer, to transfer the image from the image bearing face onto a recording medium at a transfer section between the transferer and the image bearer. The first guide is disposed upstream from the transfer section in a direction of delivery of the recording medium, to guide the recording medium to the transfer section. The second guide is disposed upstream from the first guide in the direction of delivery of the recording medium and spaced away from the first guide, to guide the recording medium to the transfer section. Each of the first guide and the second guide extends in a lateral direction perpendicular to the direction of delivery of the recording medium. A leading end of the second guide in the direction of delivery of the recording medium is inclined from one end to the other end of the second guide in the lateral direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
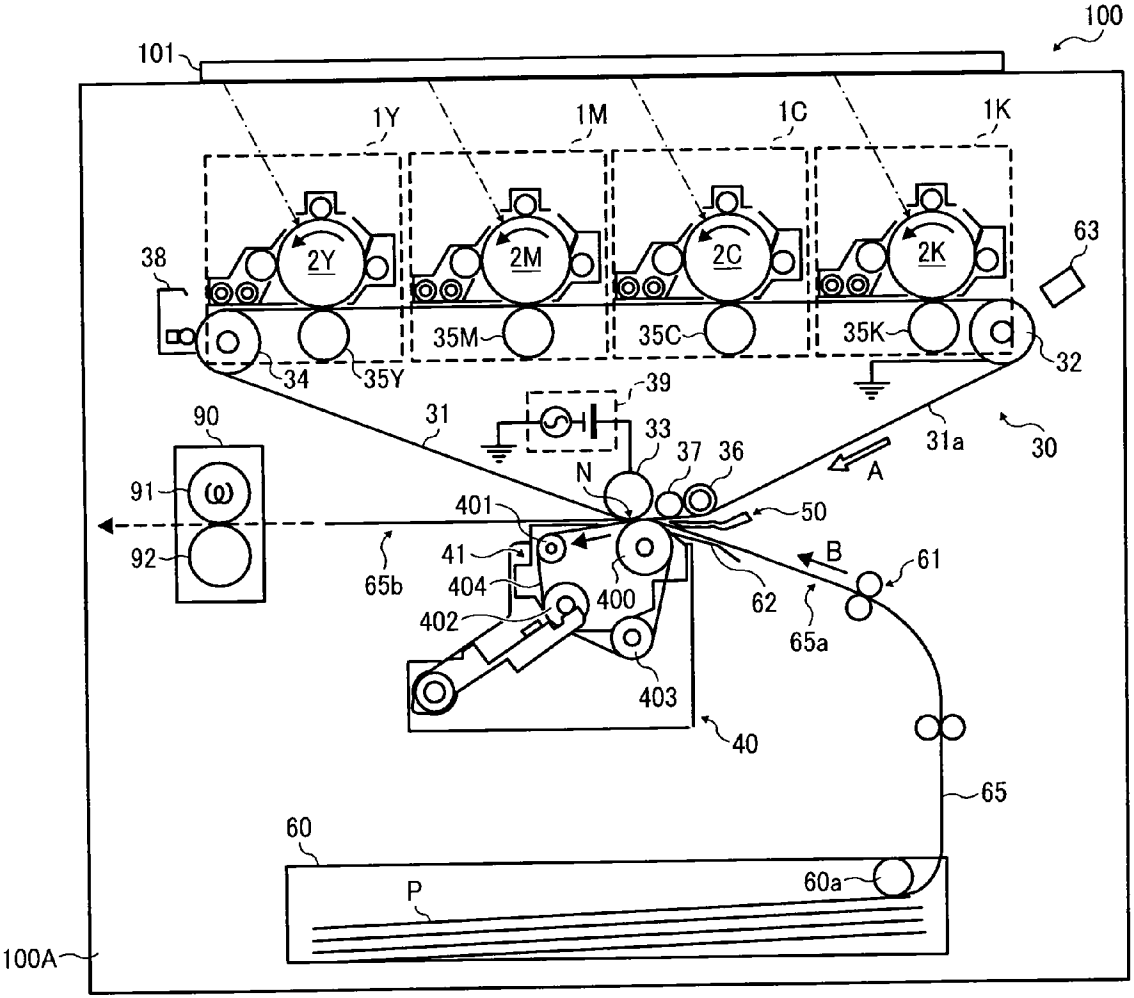
FIG. 1 is a schematic view of a configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below. In the drawings attached, components may partially be omitted for ease of understanding. It is to be noted that suffixes Y, M, C, and K denote colors yellow, magenta, cyan, and black, respectively. These suffixes may be omitted unless otherwise specified.

Below, a description is given of an image forming apparatus 100 according to an embodiment of the present disclosure. In this embodiment, the image forming apparatus 100 is illustrated as an electrophotographic color printer.

However, an image forming apparatus according to an embodiment of the present disclosure is not limited to a printer and may be, for example, a copier, a printer, a facsimile machine, and a multi-functional peripheral including a combination thereof. Note that a printer used herein includes a plotter.

Below, a configuration of an image forming apparatus 100 according to an embodiment of the present disclosure is described with reference to FIG. 1. FIG. 1 is a schematic view of the image forming apparatus 100 according to an embodiment of the present disclosure. As illustrated in FIG. 1, the image forming apparatus 100 includes four image forming units 1Y, 1M, 1C, and 1K to form toner images of yellow, magenta, cyan, and black, respectively. It is to be noted that the suffixes Y, M, C, and K denote colors of yellow, magenta, cyan, and black, respectively. To simplify the description, the suffixes Y, M, C, and K indicating colors may be omitted herein, unless colors distinguished. The image forming apparatus 100 includes a transfer unit 30 serving as a transfer device, an optical writing unit 101 serving as an exposure device, a fixing device 90, a media tray 60 to store recording media P, and a pair of registration rollers 61. The image forming units 1Y, 1M, 1C, and 1K all have the same configuration as all the others, differing only in the color of toner employed as a powder-form developing agent. The image forming units 1Y, 1M, 1C, and 1K are replaced upon reaching their product life cycles. According to the embodiment, the image forming units 1Y, 1M, 1C, and 1K are detachably attachable relative to an apparatus body 100A of the image forming apparatus 100 to be replaceable.

Figure 2:
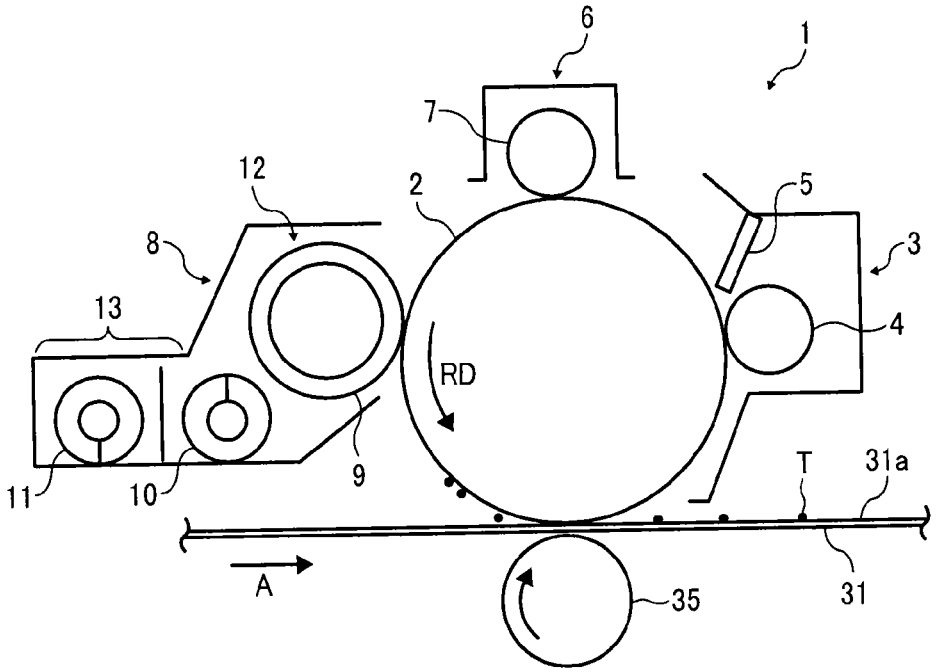
FIG. 2 is an enlarged view of an image forming unit in the image forming apparatus.

FIG. 2 is an enlarged view of one of the image forming units 1Y, 1M, 1C, and 1K as a representative example. The image forming units 1Y, 1M, 1C, and 1K all have the same configuration as all the others, differing only in the color of toner employed. Thus, the description is provided without the suffixes Y, M, C, and K indicating colors unless differentiation of the color is necessary. The image forming unit 1 includes a drum-shaped photoconductor 2 serving as a latent image bearer, a photoconductor cleaner 3, a static eliminator, a charging device 6, a developing device 8, and so forth. Such devices are held in a common casing so that they are detachably installable all together relative to the apparatus body 100A, thereby constituting a process cartridge replaceable as a single unit.

The photoconductor 2 includes a drum-shaped base and an organic photosensitive layer on a surface of the base. The photoconductor 2 is rotated in a clockwise direction indicated by arrow RD in FIG. 2 by a driving device. The charging device 6 includes a charging roller 7 serving as a charge member to which a charging bias is applied. The charging roller 7 contacts or approaches the photoconductor 2 to generate an electrical discharge therebetween, thereby charging uniformly the surface of the photoconductor 2. Instead of using the charge member, e.g., the charging roller 7 that contacts or disposed close to the photoconductor 2, for example, a corona charger that does not contact the photoconductor 2 may be employed.

The uniformly charged surface of the photoconductor 2 by the charging roller 7 is scanned by exposure light such as a light beam projected from the optical writing unit 101, thereby forming an electrostatic latent image for black on the surface of the photoconductor 2. The electrostatic latent image on the photoconductor 2 is developed with toner T of the respective color by the developing device 8. Accordingly, a visible image, also known as a toner image, is formed. The toner image formed on the photoconductor 2 is transferred primarily onto an intermediate transfer belt 31 formed into an endless loop.

The photoconductor cleaner 3 removes residual toner remaining on the surface of the photoconductor 2 after a primary transfer process, that is, after the photoconductor 2 passes through a primary transfer nip between the intermediate transfer belt 31 and the photoconductor 2. The photoconductor cleaner 3 includes a cleaning brush roller 4 which is rotated and a cleaning blade 5. The cleaning blade 5 is cantilevered, that is, one end thereof is fixed to a housing of the photoconductor cleaner 3, and the other end is a free end that contacts the surface of the photoconductor 2. The cleaning brush roller 4 rotates and brushes off the residual toner from the surface of the photoconductor 2 while the cleaning blade 5 scraping off the residual toner from the surface. The static eliminator may employ a known static eliminating device and removes residual charge remaining on the photoconductor 2 after the surface thereof is cleaned by the photoconductor cleaner 3 in preparation for the subsequent imaging cycle. The surface of the photoconductor 2 is initialized by the charge removing operation in preparation for the subsequent imaging cycle.

The developing device 8 includes a developing section 12 and a developer conveyor 13. The developing section 12 includes a developing roller 9 inside thereof. The developer conveyor 13 stirs and transports the developing agent. The developer conveyor 13 includes a first chamber equipped with a first screw 10 and a second chamber equipped with a second screw 11. The first screw 10 and the second screw 11 are rotatably supported by, e.g., a casing of the developing device 8. The first screw 10 and the second screw 11 are rotated to deliver the developing agent to the developing roller 9 while circulating the developing agent.

As illustrated in FIG. 1, the optical writing unit 101 to write latent images on the photoconductors 2 is disposed above the image forming units 1Y, 1M, 1C, and 1K. Based on image information received from an external device such as a personal computer (PC), the optical writing unit 101 optically scans the photoconductors 2Y, 2M, 2C, and 2K with a light beam projected from a laser diode of the optical writing unit 101. Accordingly, the electrostatic latent images of yellow, magenta, cyan, and black are formed on the photoconductors 2Y, 2M, 2C, and 2K, respectively.

Referring back to FIG. 1, a description is provided of the transfer unit 30. The transfer unit 30 serving as a belt unit and a transfer device is disposed substantially below the image forming units 1Y, 1M, 1C, and 1K. The transfer unit 30 includes the intermediate transfer belt 31 serving as an image bearer formed into an endless loop and rotated in the clockwise direction. A direction of rotary movement of the intermediate transfer belt 31 is referred to as a belt movement direction indicated by arrow A in FIG. 1. Besides the intermediate transfer belt 31 serving as the belt-shaped image bearer, the transfer unit 30 further includes a plurality of rollers: a drive roller 32, a secondary-transfer back surface roller 33, a cleaning auxiliary roller 34, four primary transfer rollers 35Y, 35M, 35C, and 35K, and rollers 36 and 37 serving as two rotators. The primary transfer rollers 35Y, 35M, 35C, and 35K (which may be referred to collectively as primary transfer rollers 35) are disposed opposite the photoconductors 2Y, 2M, 2C, and 2K, respectively, via the intermediate transfer belt 31. The rollers 36 and 37 may also be referred to as pressing rollers. The transfer unit 30 is detachably attachable (replaceable) relative to the apparatus body 100A. A secondary transfer unit 41 and a belt cleaning device 38 are disposed outside the loop formed by the intermediate transfer belt 31. The secondary transfer unit 41 includes a secondary transfer belt 404 serving as an image bearer and also as a secondary transferer. The secondary-transfer back surface roller 33 can be also referred to as a secondary-transfer opposed roller.

The intermediate transfer belt 31 is looped around and stretched taut between the plurality of rollers, i.e., the drive roller 32, the secondary-transfer back surface roller 33, the cleaning auxiliary roller 34, the four primary transfer rollers 35Y, 35M, 35C, and 35K, and the rollers 36 and 37. The drive roller 32 is rotated in the clockwise direction by a driving device, such as a drive motor, and rotation of the drive roller 32 causes the intermediate transfer belt 31 to rotate in the same direction. In the transfer unit 30, the intermediate transfer belt 31 is looped around the plurality of rollers, thereby delivering a recording medium P.

The intermediate transfer belt 31 is interposed between the primary transfer rollers 35Y, 35M, 35C, and 35K, and the photoconductors 2Y, 2M, 2C, and 2K, thereby forming primary transfer nips serving as transfer sections for each color between a front surface 31*a* or an image bearing face of the intermediate transfer belt 31 and the photoconductors 2Y, 2M, 2C, and 2K. A primary transfer bias is applied to the primary transfer rollers 35Y, 35M, 35C, and 35K by a transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K.

An yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electric field and the nip pressure. The intermediate transfer belt 31, on which the yellow toner image has been transferred, passes through the primary transfer nips of magenta, cyan, and black. Subsequently, a magenta toner image, a cyan toner image, and a black toner image on the photoconductors 2M, 2C, and 2K, respectively, are superimposed on the yellow toner image which has been transferred on the intermediate transfer belt 31, one atop the other in the primary transfer process. Accordingly, a composite toner image, in which the toner images of four different colors are superimposed on one atop the other, is formed on the surface of the intermediate transfer belt 31 in the primary transfer process. According to the present embodiment, roller-type primary transferers, that is, the primary transfer rollers 35Y, 35M, 35C, and 35K, are employed as primary transferers. Alternatively, a transfer charger and a brush-type transferer may be employed as the primary transferer.

The secondary transfer unit 41 is disposed outside the loop of the intermediate transfer belt 31. A nip forming roller 400 of the transfer unit 30 is disposed outside the loop formed by the intermediate transfer belt 31, opposite to the secondary-transfer back surface roller 33. The intermediate transfer belt 31 is interposed between the secondary-transfer back surface roller 33 and the nip forming roller 400, thereby forming a secondary transfer nip N at which the front surface 31*a* of the intermediate transfer belt 31 contacts the secondary transfer belt 404. A secondary transfer bias is applied to the secondary-transfer back surface roller 33 by a secondary-transfer bias power source 39 (hereinafter referred to as power source 39). With this configuration, a secondary-transfer electrical field is formed between the secondary-transfer back surface roller 33 and the secondary transfer belt 404 so that the toner T having a negative polarity is moved electrostatically from the secondary-transfer back surface roller 33 to the secondary transfer belt 404.

As illustrated in FIG. 1, the media tray 60 to store a bundle of recording media P, such as paper sheets or resin sheets, is disposed below the transfer unit 30. The media tray 60 is equipped with a feed roller 60*a* to contact a topmost one of recording media P in the media tray 60. The feed roller 60*a* is rotated at predetermined timing to pick up and send the topmost one of the recording media P from the media tray 60 to a delivery path 65 in the secondary transfer nip N. On the delivery path 65 are disposed a pair of conveyance rollers, the pair of registration rollers 61, a lower guide 62, and an upper guide unit 50 (hereinafter referred to as the guide unit 50). Of the delivery path 65, a delivery path between the pair of registration rollers 61 and the secondary transfer nip N is referred to as a pre-nip delivery path 65*a*. The pair of registration rollers 61 is rotated to feed a recording medium P to the secondary transfer nip N so that the four-color superimposed toner images on the front surface 31*a* of the intermediate transfer belt 31 are synchronously transferred on a recording medium P fed from the media tray 60 into the secondary transfer nip N.

In the transfer unit 30, the intermediate transfer belt 31 is an endless looped belt serving as an image bearer to bear a toner image transferred thereon. In the transfer unit 30, the intermediate transfer belt 31 is looped around and supported with the plurality of rollers, i.e., the drive roller 32, the secondary-transfer back surface roller 33, the cleaning auxiliary roller 34, and the rollers 36 and 37. Accordingly, the transfer unit 30 acts as a belt unit to deliver the toner images transferred on the intermediate transfer belt 31 to the secondary transfer nip N serving as a transfer section at which the toner image is transferred from the intermediate transfer belt 31 to the recording medium P in the secondary transfer process.

In the secondary transfer nip N, the recording medium P tightly contacts the composite toner image on the front surface 31*a* of the intermediate transfer belt 31, and the four-color superimposed toner images are collectively transferred onto the recording medium P by a secondary transfer electric field and a nip pressure applied thereto, thereby forming a full-color toner image in combination with white color of the recording medium P. After passage of the secondary transfer nip N, untransfered residual toner remains on the intermediate transfer belt 31. The residual toner is removed from the intermediate transfer belt 31 by the belt cleaning device 38 which contacts the front surface 31*a* of the intermediate transfer belt 31. The cleaning auxiliary roller 34 inside the loop formed by the intermediate transfer belt 31 supports the cleaning operation performed by the belt cleaning device 38. A potential sensor 63 is disposed outside the loop formed by the intermediate transfer belt 31. More specifically, of the entire circumferential area of the intermediate transfer belt 31, the potential sensor 63 is disposed opposite to a portion of the intermediate transfer belt 31 wound around the drive roller 32 with a predetermined gap between the potential sensor 63 and the intermediate transfer belt 31. The surface potential of the toner image primarily transferred onto the intermediate transfer belt 31 is measured with the potential sensor 63 when the toner image comes to a position opposite to the potential sensor 63.

A post-nip delivery path 65*b* is disposed downstream of the secondary transfer nip N in a direction of delivery of a recording medium P indicated by arrow B (hereinafter, the delivery direction B). Hereinafter, the downstream side in the delivery direction B of the recording medium P is referred to as a downstream side in the delivery direction. The downstream side in the delivery direction means a left side of the secondary transfer nip N in FIG. 1. The fixing device 90 is disposed on the post-nip delivery path 65*b*. The recording medium P having the composite toner image transferred thereon is delivered into the fixing device 90. The fixing device 90 includes a fixing roller 91 including a heat source inside thereof and a pressing roller 92. The fixing roller 91 and the pressing roller 92 contact to form a fixing nip where heat and pressure are applied. The composite toner image is softened and fixed on the recording medium P as the recording medium P passes through the fixing nip. After the toner image is fixed on the recording medium P, the recording medium P is delivered from the fixing device 90. Subsequently, the recording medium P is ejected outside the apparatus body 100A via the post-nip delivery path 65*b*.

In the apparatus body 100A, the secondary transfer unit 41 is supported with a first support assembly 40. The first support assembly 40 detachably supports the secondary transfer unit 41. The secondary transfer unit 41 is replaceable independently as a single unit. The secondary transfer unit 41 includes the nip forming roller 400 serving as a rotator and a transferer disposed opposite to the secondary-transfer back surface roller 33 via the intermediate transfer belt 31. The secondary transfer unit 41 includes three rollers 401, 402, and 403 serving as three rotators, and a secondary transfer belt 404 looped around the nip forming roller 400 and three rollers 401, 402, and 403. The secondary transfer belt 404 serves as an image bearer and a transferer. In other words, the secondary transfer unit 41 is a belt conveyor unit in which the secondary transfer belt 404 is an endless looped belt serving as an image bearer, and is looped around the plurality of rollers, i.e., the nip forming roller 400 and the rollers 401, 402, and 403. The nip forming roller 400 is also referred to as a secondary transfer roller.

The nip forming roller 400 secondarily transfers the toner image from the front surface 31*a* of the intermediate transfer belt 31 onto the recording medium P. The nip forming roller 400 is disposed inside the belt loop of the secondary transfer belt 404, facing to the secondary-transfer back surface roller 33. The intermediate transfer belt 31 and the secondary transfer belt 404 are interposed between the nip forming roller 400 and the secondary-transfer back surface roller 33. The nip forming roller 400 is biased against the secondary transfer belt 404 so as to pressingly contact the secondary transfer belt 404, thereby forming the secondary transfer nip N between the intermediate transfer belt 31 and the secondary transfer belt 404.

In this embodiment, the power source 39 applies bias for secondary transfer (secondary transfer bias) to the secondary-transfer back surface roller 33. In some embodiments, the power source 39 applies secondary transfer bias to the nip forming roller 400. In a case in which the secondary transfer bias is applied to the nip forming roller 400, the secondary transfer bias having a polarity opposite that of the toner is applied to the nip forming roller 400. In a case in which the secondary transfer bias is applied to the secondary-transfer back surface roller 33, the secondary transfer bias having the same polarity as that of the toner is applied to the secondary-transfer back surface roller 33. The roller 401 is to strip the recording medium P, which is electrostatically attracted to the secondary transfer belt 404, from the secondary transfer belt 404 by self stripping along the curvature of the roller 401.

Figure 16A:
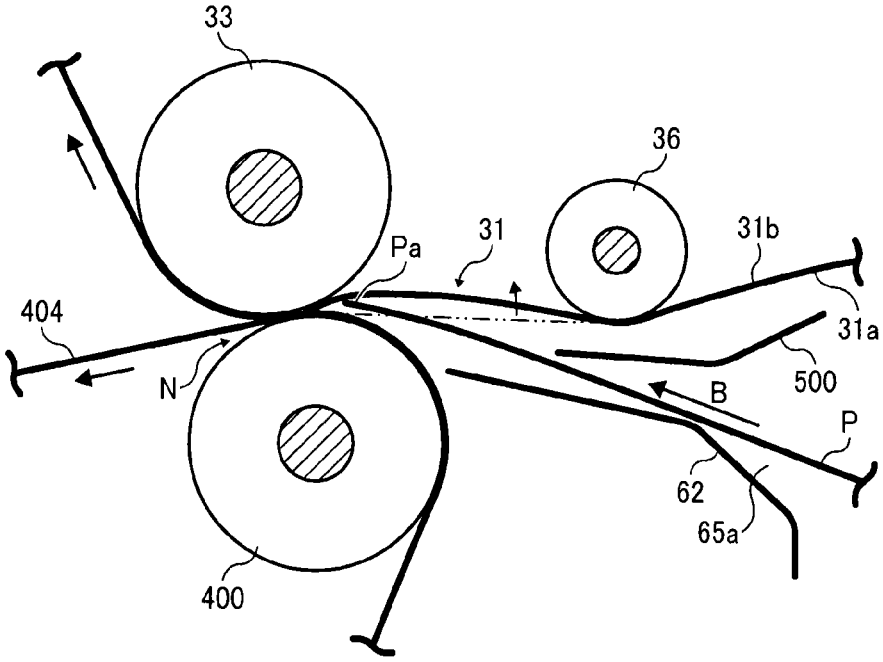
FIG. 16A is an enlarged view of a state in which a leading end of a recording medium has passed a first guide and a second guide according to a comparative example.
Figure 16B:
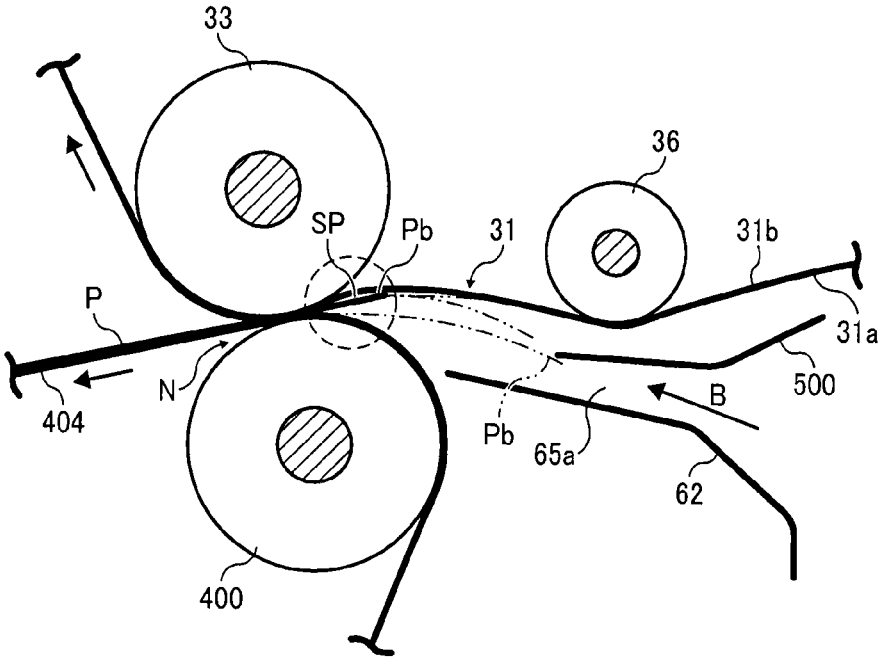
FIG. 16B is an enlarged view of a state in which a trailing end of the recording medium has passed the first guide according to the comparative example.

Next, a description is given of the configuration of the upstream side from the secondary transfer nip N in the delivery direction B (hereinafter, referred to as an upstream side in the delivery direction). FIGS. 16A and 16B are schematic views of a configuration of a comparative example of the upstream side from the secondary transfer nip N in the delivery direction B. In the comparative example, the lower guide 62 is disposed below the pre-nip delivery path 65*a* disposed between the secondary transfer nip N and the pair of registration rollers 61 in the delivery direction B. An upper guide 500 is also disposed above the pre-nip delivery path 65*a* and opposite the lower guide 62. A roller 36 is disposed upstream from the secondary-transfer back surface roller 33 in the delivery direction B and in contact with a back surface 31*b* serving as a non image bearing face of the intermediate transfer belt 31. A recording medium P delivered to the secondary transfer nip N is originally flat. However, the recording medium P is deformed by contact with the delivery path 65 and/or the upper guide 500 and is likely to be delivered in a curled state. In other words, the recording medium P is curled toward a front surface (image transferred surface) of the recording medium P between the pair of registration rollers 61 and the secondary transfer nip N. In such a configuration, as illustrated in FIG. 16A, a leading end Pa of the recording medium P fed between the lower guide 62 and the upper guide 500 passes the upper guide 500 and contacts the front surface 31*a* of the intermediate transfer belt 31 between the roller 36 and the secondary transfer nip N. The contact of the leading end Pa of the recording medium P presses the intermediate transfer belt 31 toward the inside of the belt loop and fluctuates the intermediate transfer belt 31. In such a case, the recording medium P and the intermediate transfer belt 31 (the front surface 31*a*) repeats contact and separation, thus disturbing toner images or a transferred composite image and causing an abnormal image.

When the recording medium P is further delivered, the leading end Pa is guided into the secondary transfer nip N. The front surface 31*a* of the intermediate transfer belt 31 and the recording medium P tightly contact each other and enter the secondary transfer nip N. After a trailing end Pb of the recording medium P passes the upper guide 500, as illustrated in FIG. 16B, the trailing end Pb of the recording medium P curls toward the intermediate transfer belt 31 and contacts the front surface 31*a*. In this case, if the contact of the trailing end Pb of the recording medium P against the front surface 31*a* is moderate, it does not matter. However, the way of curling varies depending on the strength (thickness) or delivery speed of the recording medium P. If the recording medium P strongly hits the front surface 31*a* of the intermediate transfer belt 31, the recording medium P would be rapidly pushed up toward the inside of the loop of the intermediate transfer belt 31. As a result, the front surface 31*a* of the intermediate transfer belt 31 with the trailing end Pb of the recording medium P would not tightly contact each other. Then, if a space SP is formed between the trailing end Pb and the front surface 31*a* at a position upstream from the secondary transfer nip N in the delivery direction B, a secondary transfer bias would cause an electric discharge in the space SP, thus resulting in an abnormal image due to disturbance of toner images.

Since the upper guide 500 is disposed opposite the intermediate transfer belt 31 and contacts the recording medium P, the upper guide 500 is charged by friction with the recording medium P and increases the surface potential as the number of recording media P passing the upper guide 500 increases. As the surface potential of the upper guide 500 increases, the upper guide 500 more attracts toner from the intermediate transfer belt 31. As a result, an electric discharge would occur between charged toner on the upper guide 500 and the intermediate transfer belt 31, thus causing an abnormal image. Therefore, in the comparative example, an electrically-grounded conductive member is disposed at a portion of the upper guide 500 to contact a recording medium P, to prevent the upper guide 500 from being charged. Such a configuration in which only the conductive member is disposed might reduce occurrence of an abnormal image. However, since the conductive member is disposed at the portion at which the upper guide 500 is to contact a recording medium P, the recording medium P might be damaged.

Hence, in this embodiment, as illustrated in FIGS. 3 through 6, the guide unit 50 including a first guide 51 and a second guide 52 is disposed above the pre-nip delivery path 65*a*, which is disposed upstream from the secondary transfer nip N in the delivery direction B of a recording medium P.

The guide unit 50 includes a mount 53 serving as a conductive base and the first guide 51 and the second guide 52 serving as high resistance members joined to the mount 53 so as to project from the mount 53 toward the secondary transfer nip N. Of the first guide 51 and the second guide 52, a conductive member is disposed on a joined face, which is disposed near the front surface 31*a* of the intermediate transfer belt 31, between the first guide 51 and the mount 53, so as not to spread over the joined face.

In this embodiment, the first guide 51 acts as a functional member to press a leading end Pa or the entire of a recording medium P, and the second guide 52 acts as a functional member to reduce an impact caused by the trailing end Pb of the recording medium P which is returning from a curled state to a flat state. Accordingly, in this embodiment, the leading end Pa and the trailing end Pb of the recording medium P are guided with two separate guides, the first guide 51 and the second guide 52, which differ from the comparative example in which a single guide, the upper guide 500, guides the leading end Pa and the trailing end Pb.

Figure 3:
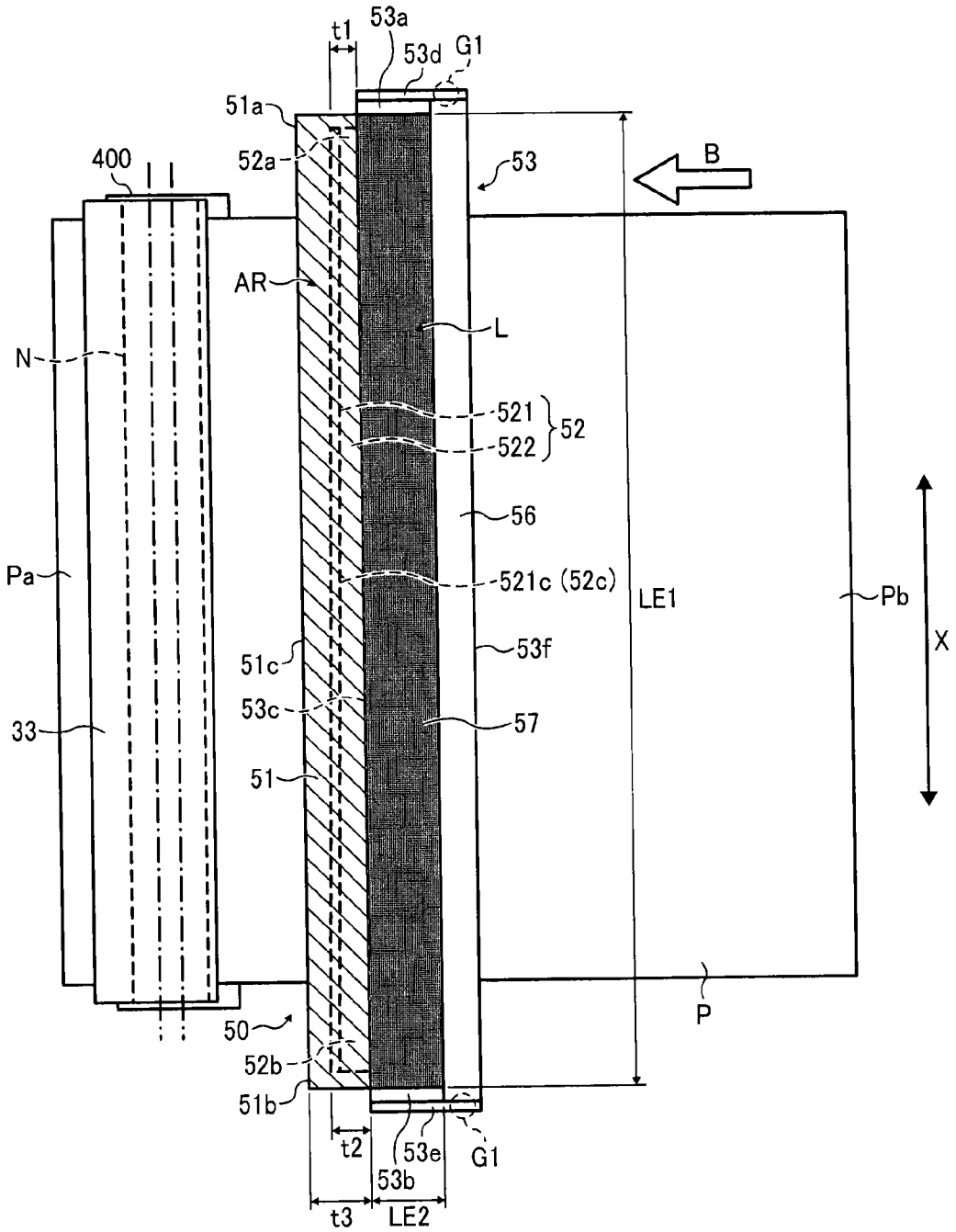
FIG. 3 is a plan view of the configuration and arrangement of a first guide and a second guide according to an embodiment of this disclosure.

The guide unit 50 includes the mount 53 made of metal and the first guide 51 and the second guide 52 mounted on the mount 53. The first guide 51 and the second guide 52 are film members made of insulative (highly resistive) resin. The first guide 51 and the second guide 52 made of, for example, polycarbonate (PC) or polyethyleneterephthalate (PET). As illustrated in FIG. 3, the first guide 51 is disposed upstream from the secondary transfer nip N in the delivery direction B of a recording medium P and opposite the front surface 31*a* of the intermediate transfer belt 31 (see FIG. 7), to guide the recording medium P toward the secondary transfer nip N. The second guide 52 is disposed upstream from the first guide 51 in the delivery direction B of the recording medium P, and a portion of the second guide 52 is disposed opposite the first guide 51 to guide the recording medium P toward the secondary transfer nip N. In other words, the second guide 52 is disposed upstream from the first guide 51 in the delivery direction B and away from the first guide 51. The first guide 51 and the second guide 52 also regulate movement of the recording medium P toward the front surface 31*a* of the intermediate transfer belt 31.

Figure 4:
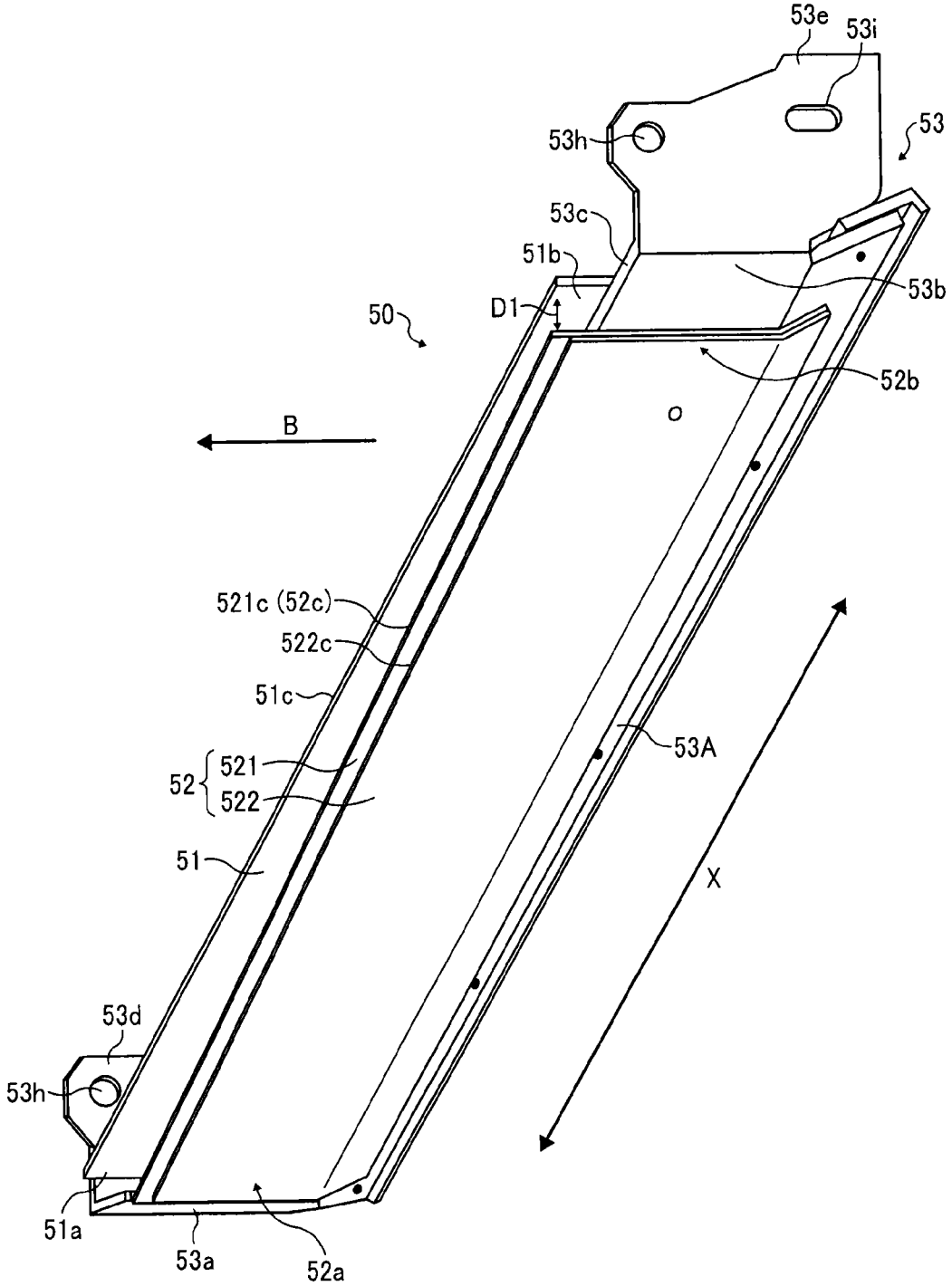
FIG. 4 is an enlarged perspective view of the first guide and the second guide of FIG. 3.

As illustrated in FIGS. 3 and 4, the first guide 51 has a rectangular shape extending in a lateral direction X (also referred to as a width direction) perpendicular to the delivery direction B. The first guide 51 has a leading end 51*c* that is a long end extending from one end 51*a* to the other end 51*b* in the lateral direction X. The first guide 51 has a lateral end 51A mounted on an upper face 53*f* illustrated in FIGS. 5 and 6, which is an opposing face of the mount 53 opposing the intermediate transfer belt 31, so that the leading end 51*c* projects from a downstream end 53*c* of the mount 53 toward the secondary transfer nip N. The first guide 51 is attached to the upper face 53*f* by, e.g., a double-sided adhesive tape 57 made of a conductive member so that, as illustrated in FIG. 3, the leading end 51*c* extending in the lateral direction X is perpendicular to the delivery direction B in plan view. Thus, the first guide 51 is disposed opposite the rollers 36 and 37.

The double-sided adhesive tape 57 adheres the mount 53 to the first guide 51. The double-sided adhesive tape 57 is disposed over an entire contact area L of the first guide 51 with the mount 53, the contact area L having a length LE1 in the long direction and a length LE2 in the short direction illustrated in FIG. 2. In FIG. 3, the left-side end of the double-sided adhesive tape 57 is disposed so as not to spread over the downstream end 53*c* of the mount 53. In other words, the area of the double-sided adhesive tape 57 is an entire area of the joined face (the contact area L) in which the mount 53 contacts the first guide 51, and the double-sided adhesive tape 57 is disposed so as not to spread over the entire area of the joined face (the contact area L). The double-sided adhesive tape 57 is made of any conductive and adhesive materials, for example, a combination of aluminum foil and a conductive acrylic adhesive. The resistance value of the double-sided adhesive tape 57 is about 0.5 $\Omega/cm^2$.

As illustrated in FIGS. 3 and 4, the second guide 52 has a substantially rectangular shape extending in the lateral direction X perpendicular to the delivery direction B. The second guide 52 has a leading end 52*c* that is a long end extending from one end 52*a* to the other end 52*b* in the lateral direction X. The second guide 52 has a lateral end 52A mounted on a lower face 53*g* illustrated in FIGS. 5 and 6, which is an opposite face of the mount 53 disposed at a side opposite the upper face 53*f*, so that the leading end 52*c* projects from the downstream end 53*c* of the mount 53 toward the secondary transfer nip N. The lateral end 52A of the second guide 52 is attached to the lower face 53*g* of the mount 53 by, e.g., a non-conductive, double-sided adhesive tape 58. The second guide 52 is attached to the lower face 53*g* via, e.g., the double-sided adhesive tape 58 so that the leading end 52*c* extending in the lateral direction X is inclined from the end 52*a* to the other end 52*b* in the lateral direction X relative to the direction perpendicular to the delivery direction B. In other words, the second guide 52 is inclined from the end 52*a* to the other end 52*b* in an area AR having a projecting amount t3 of the leading end 51*c* beyond the downstream end 53*c* in FIG. 3, which is an opposing area in which the second guide 52 opposes the first guide 51. The leading end 52*c* of the second guide 52 is inclined so that a projecting amount t2 of the other end 52*b* beyond the downstream end 53*c* is greater than a projecting amount t1 of the end 52*a* beyond the downstream end 53*c*. The second guide 52 is disposed further away from the front surface 31*a* of the intermediate transfer belt 31 than the first guide 51 is. Accordingly, since the second guide 52 is less affected by an electric discharge from the front surface 31*a* of the intermediate transfer belt 31 than the first guide 51 is, a conductive member can be obviated. Since the cost per unit of the conductive, double-sided adhesive tape 57 may be higher than the non-conductive, double-sided adhesive tape 58, using the non-conductive, double-sided adhesive tape 58 to join the second guide 52 with the mount 53 preferably allows cost reduction. Note that, if the second guide 52 is affected by an electric discharge from the front surface 31*a* of the intermediate transfer belt 31, the conductive, double-sided adhesive tape 57 may be used for the second guide 52.

Figure 6:
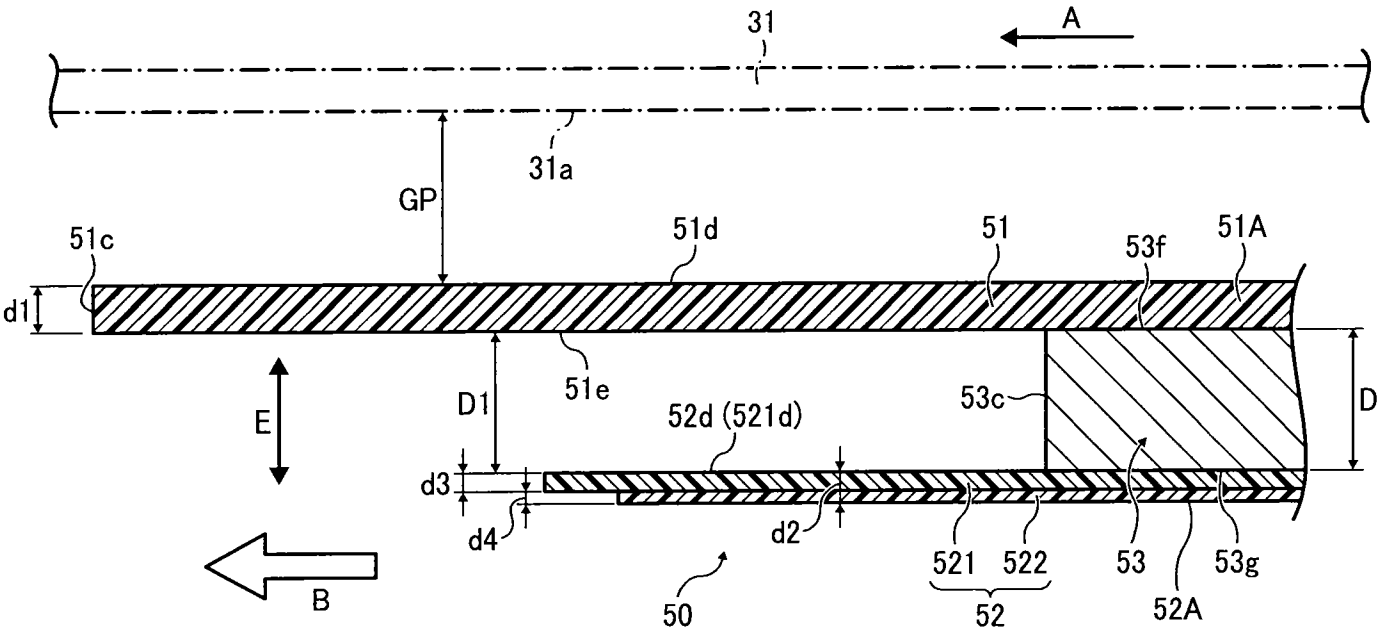
FIG. 6 is an enlarged cross-sectional view of the first guide and the second guide of FIG. 5.

As illustrated in FIG. 6, the first guide 51 and the second guide 52 are disposed opposing each other with a gap D1 in a direction (hereinafter, adjoin-separation direction) indicated by arrow E in FIG. 6 to adjoin and separate from the front surface 31*a* of the intermediate transfer belt 31, that is, a direction in which each of the first guide 51 and the second guide 52 opposes the front surface 31*a* of the intermediate transfer belt 31. In other words, the mount 53 has a thickness D in the adjoin-separation direction E. The first guide 51 is attached to the upper face 53*f* of the mount 53, and the second guide 52 is attached to the lower face 53*g* of the mount 53. Accordingly, the first guide 51 and the second guide 52 are disposed on the mount 53 so that the first guide 51 and the second guide 52 oppose and separate from each other at a distance corresponding to the thickness D of the mount 53. The predetermined gap D1 used herein represents a gap between a back face 51*e* of the first guide 51 and an upper face 52*d* of the second guide 52 that are opposing faces of the first guide 51 and the second guide 52.

Figure 5:
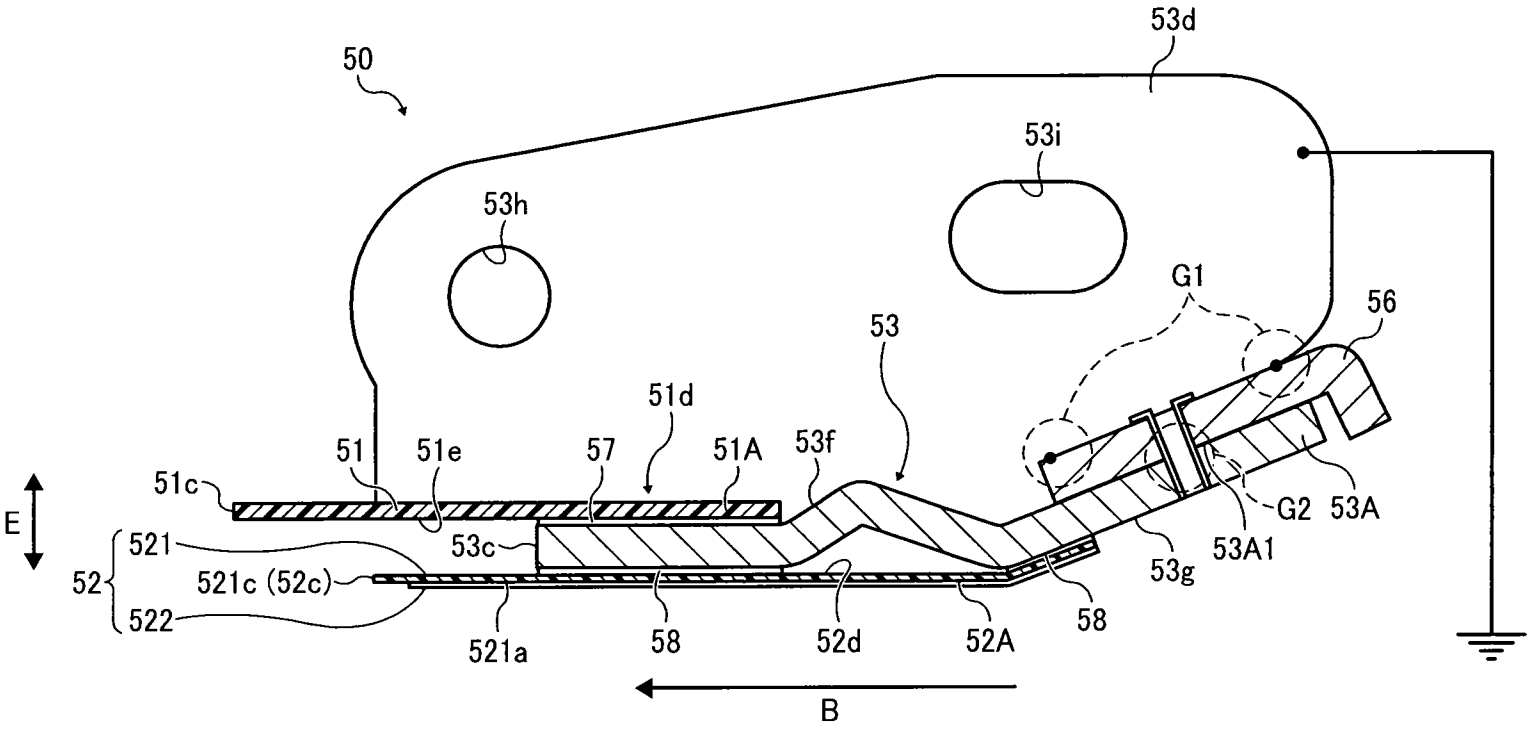
FIG. 5 is a cross-sectional view of the first guide and the second guide of FIG. 4.

In this embodiment, as illustrated in FIGS. 5 and 6, the second guide 52 includes a plurality of sheets 521 and 522 made of resin that are shifted from each other in the delivery direction B and laminated one on another in the adj oin-separation direction E. The sheet 521 is dimensioned so that a leading end 521*c* of the sheet 521 more projects from the downstream end 53*c* of the mount 53 than a leading end 522*c* of the sheet 522, and is attached to the lower face 53*g* of the mount 53. The sheet 522 is adhered to a lower face 521*a* of the sheet 521. In other words, for this embodiment, the projecting amounts t1 and t2 of the second guide 52 are of the sheet 521. The predetermined gap D1 used herein represents a gap between the back face 51*e* of the first guide 51 and an upper face 521*d* of the sheet 521 that are opposing faces of the first guide 51 and the second guide 52 before deformation. The term "before deformation" means a state of the gap before the gap is deformed by the contact of the recording medium P against the second guide 52.

The first guide 51 and the second guide 52 are dimensioned to satisfy d1≥d2, where d1 is the thickness of the first guide 51 in the adjoin-separation direction E and d2 is the thickness of the second guide 52. The thickness d2 of the second guide 52 includes a thickness d3 of the sheet 521 and a thickness d4 of the sheet 522. Note that the relation of d1>d2 is preferable to allow the trailing end Pb of the recording medium P to more smoothly move from the second guide 52 to the first guide 51.

The configuration of the multiple sheets 521 and 522 laminated facilitates adjustment of the thickness of the second guide 52. In other words, the first guide 51 presses the leading end Pa or the entire of the recording material P during passage, at a position upstream from the secondary transfer nip N in the delivery direction B. Accordingly, the first guide 51 has a hardness sufficient to prevent contact with the front surface 31*a* of the intermediate transfer belt 31 even when the first guide 51 is elastically deformed by contact with the recording medium P. By contrast, the second guide 52 has a flexibility, rather than a hardness, sufficient to elastically deform by contact with the trailing end Pb of the recording medium P. Accordingly, it may be more difficult to set the thickness d2 with a single sheet. Hence, in this embodiment, the multiple sheets are preferably laminated to obtain the desired thickness d2. Thus, the thickness d1 of the first guide 51 and the thickness d2 of the second guide 52 are set to satisfy the relation of d1≥d2. Note that the number of sheets constituting the second guide 52 is not limited to two and may be two or more. Alternatively, if proper elastic deformation is obtained, the second guide may be made of a single sheet.

Next, a description is given of a configuration of the mount 53. The mount 53 is a conductive metal member and mounted on metal side plates of the transfer unit 30. The side plates of the transfer unit 30 are electrically grounded, and thus the mount 53 is also electrically grounded via the side plates of the transfer unit 30. As illustrated in FIG. 3, the mount 53 has a rectangular shape extending in the lateral direction X, and is longer in the lateral direction X than each of the first guide 51 and the second guide 52. Opposed ends 53*a* and 53*b* of the mount 53 in the lateral direction X are bent upward in a side view perpendicular to the lateral direction X and provided with side mount faces 53*d* and 53*e*, respectively. The first guide 51 and the second guide 52 are mounted the mount 53 mounted on the mount 53 at the predetermined gap D1 away from each other. Such arrangement of the first guide 51 and the second guide 52 with the predetermined gap D1 secures a deformation area of the second guide 52. Accordingly, the thickness D of a portion of the mount 53 on which the lateral end 51A of the first guide 51 and the lateral end 52A of the second guide 52 are mounted is at least equal to the predetermined gap D1. The thickness D of the mount 53 is slightly different in size from the predetermined gap D1. This is because the first guide 51 and the second guide 52 are attached to the upper face 53*f* and the lower face 53*g* with the double-sided adhesive tape and the predetermined gap D1 includes the thickness D and the thickness of the double-sided adhesive tape. Note that the first guide 51 and the second guide 52 may be attached to the upper face 53*f* and the lower face 53*g* without using the double-sided adhesive tape (the conductive member) 57. For example, in a configuration in which a conductive liquid adhesive is employed, it is not necessary to consider the thickness of the double-sided adhesive tape (the conductive member) 57, and the thickness D of the mount 53 equals to the predetermined gap D1.

As illustrated in FIGS. 4 and 5, each of the side mount faces 53*d* and 53*e* of the mount 53 includes holes 53*h* and 53*i*. By inserting, e.g., pins or shafts of, e.g., the metal side plates of the transfer unit 30 into the holes 53*h* and 53*i* of the mount 53, the guide unit 50 is supported with and fixed to the side plates. Accordingly, the guide unit 50 preferably has a desired hardness. However, considering the predetermined gap D1, the thickness D would be limited. Hence, in this embodiment, a reinforcement 56 made of metal is joined to the mount 53 to partially increase the thickness of the mount 53. The reinforcement 56 has an L shape in cross section extending in the lateral direction X. The reinforcement 56 is disposed between the side mount faces 53*d* and 53*e* at a rear end 53A opposite a side of the mount 53 on which the first guide 51 and the second guide 52 are mounted. In this embodiment, as illustrated in FIG. 3, the reinforcement 56 is joined to the side mount faces 53*d* and 53*e*, and mounted on and joined to an upper face 53A1 of the rear end 53A. As illustrated in FIG. 3, a joined portion G1 between the reinforcement 56 and each of the side mount faces 53*d* and 53*e* is welded, and a joined portion G2 between the reinforcement 56 and the upper face 53A1 is caulked to form a single unit. The mount 53 is made of conductive metal, and is electrically grounded via the metal side plates of the transfer unit 30.

As described above, the formation of the mount 53 by joining multiple metal members preferably obtains a desired hardness while securing the predetermined gap D1 between the first guide 51 and the second guide 52. In addition, as illustrated in FIG. 6, the hardness stably maintains a gap GP between the front surface 31*a* of the intermediate transfer belt 31 and the opposing face 51*d* of the first guide 51 opposing the front surface 31*a*.

Next, action of the guide unit 50 is described with reference to FIGS. 7A through 10B.

Figure 7A:
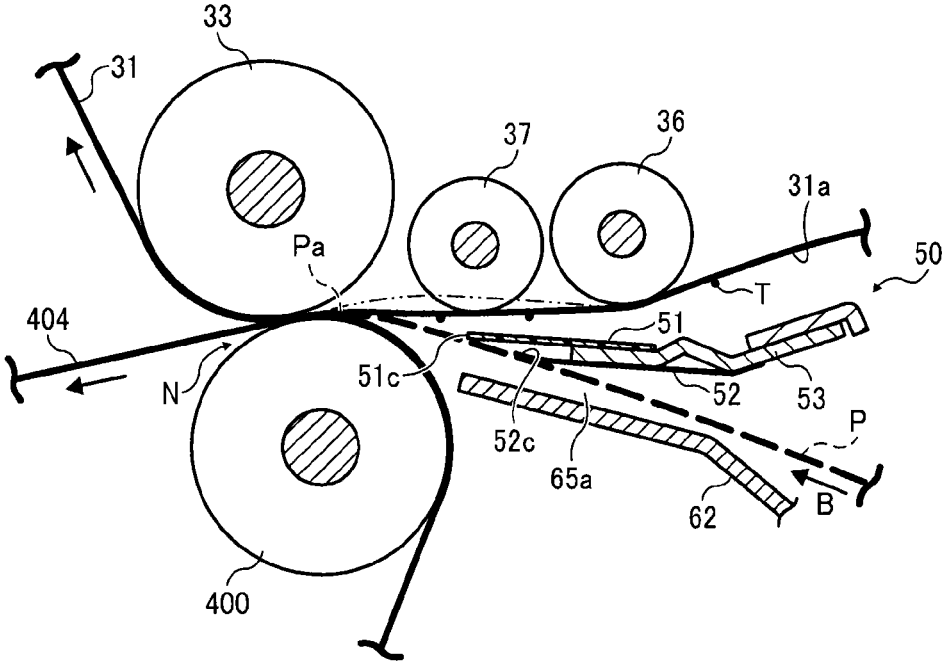
FIG. 7A is an enlarged view of a state in which a leading end of a strong recording medium has passed the first guide and the second guide.

FIGS. 7A, 7B, 8A, and 8B show states of passage of a thick sheet of paper serving as a strong recording medium P. FIGS. 9A, 9B, 10A, and 10B show states of passage of a thin sheet of paper serving as a weak recording medium P1, which has a lower basis weight than that of the thick sheet. As illustrated in FIG. 7A, the thick recording medium P is fed to the pre-nip delivery path 65*a* between the lower guide 62 and the guide unit 50. Depending on a delivery state, the leading end Pa of the thick recording medium P contacts the leading end 52*c* of the second guide 52, which is disposed more upstream in the delivery direction B, and the leading end 51*c* of the first guide 51 and passes the pre-nip delivery path 65*a*. The leading end Pa passes the guide unit 50 and contacts the front surface 31*a* of the intermediate transfer belt 31 between the roller 37 and the secondary transfer nip N. By the contact, the leading end Pa might push up the intermediate transfer belt 31 toward the inside of the belt loop and cause vibration of the intermediate transfer belt 31. In this embodiment, however, the roller 37 prevents the intermediate transfer belt 31 from being pushed up toward the inside of the loop of the intermediate transfer belt 31. The leading end 51*c* of the first guide 51 is disposed perpendicular to the delivery direction B in plan view. Accordingly, when the recording medium P passes below the leading end 51*c* of the first guide 51, the leading end 51*c* evenly contacts the recording medium P and is guided to the secondary transfer nip N, thus allowing stable entry of the leading end Pa of the recording medium P to the secondary transfer nip N.

As the leading end Pa of the recording medium P enters the secondary transfer nip N, the recording medium P more warps. However, the first guide 51 has a desired hardness, thus preventing the first guide 51 from being excessively bent toward the intermediate transfer belt 31. Accordingly, since the contact of the front surface 31*a* with the first guide 51 is prevented, the vibration of the intermediate transfer belt 31 is reduced, thus preventing occurrence of an abnormal image due to disturbance of a toner image borne on the front surface 31*a*.

Figure 7B:
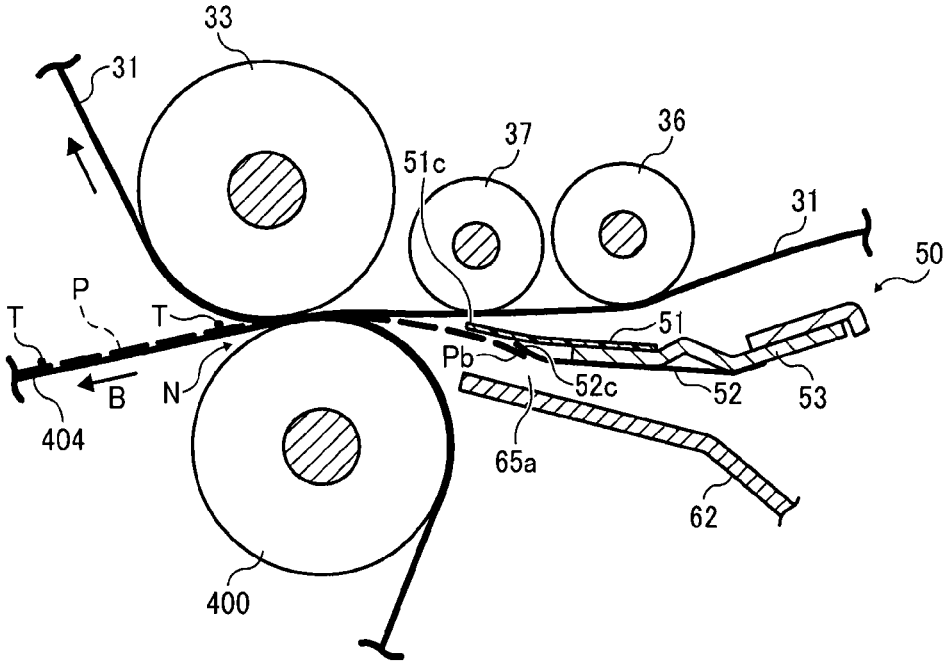
FIG. 7B is an enlarged view of a state in which a trailing end of the strong recording medium passes the second guide.

When the recording medium P is further delivered, the leading end Pa is guided into the secondary transfer nip N. The front surface 31*a* of the intermediate transfer belt 31 and the recording medium P tightly contact each other and enter the secondary transfer nip N. As illustrated in FIG. 7B, when the trailing end Pb of the recording medium P arrives at a lower portion of the guide unit 50, the trailing end Pb of the recording medium P moves while contacting the second guide 52. The second guide 52 is formed to be more easily bent, thus moderating the restoring action of the trailing end Pb of the recording medium P to return from the warping state into a flat state. Additionally, the second guide 52 is disposed away from the first guide 51, which is disposed above the second guide 52, at the predetermined gap D1 allowing deformation of the second guide 52. Accordingly, the second guide 52 can be sufficiently bent by the designed deformation amount, thus absorbing a restoration force of the trailing end Pb to return to the flat state.

Figure 8A:
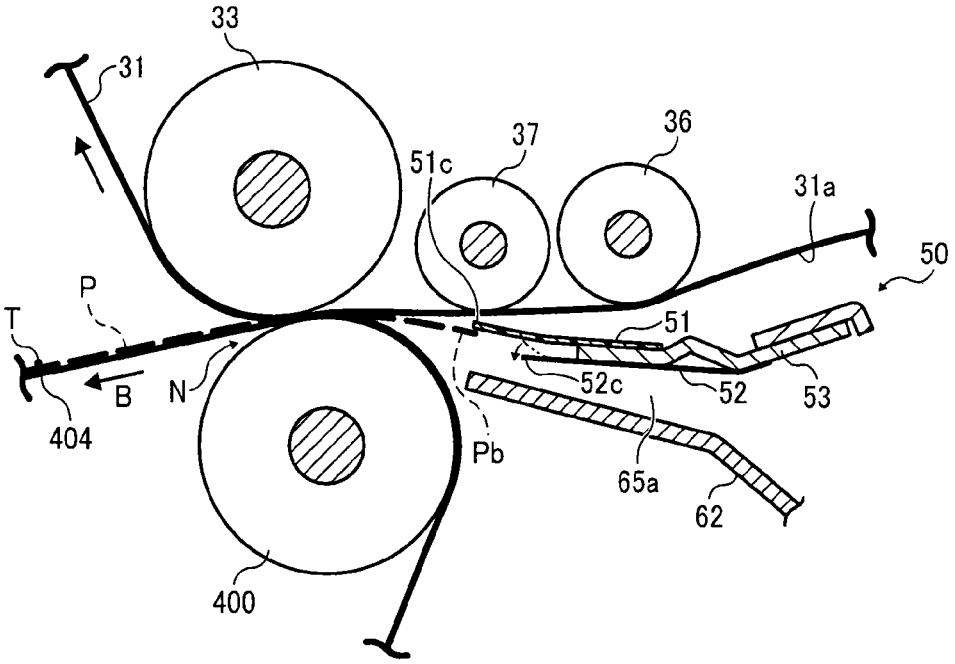
FIG. 8A is an enlarged view of a state in which the trailing end of the strong recording medium has moved from the second guide to the first guide.

The leading end 52*c* of the second guide 52 is disposed to be inclined relative to the delivery direction B in an area from the end 52*a* to the other end 52*b* in the lateral direction X. In other words, the leading end 52*c* of the second guide 52 is inclined so that a projecting amount t1 of the end 52*a* beyond the downstream end 53*c* is greater than a projecting amount t2 of the other end 52*b* beyond the downstream end 53*c*. Accordingly, as the recording medium P is delivered in the delivery direction B, the contact area of the second guide 52 with the recording medium P increases. Such a configuration moderates deformation of the second guide 52 toward the first guide 51. As illustrated in FIG. 8A, the trailing end Pb of the recording medium P smoothly moves to the first guide 51.

Figure 8B:
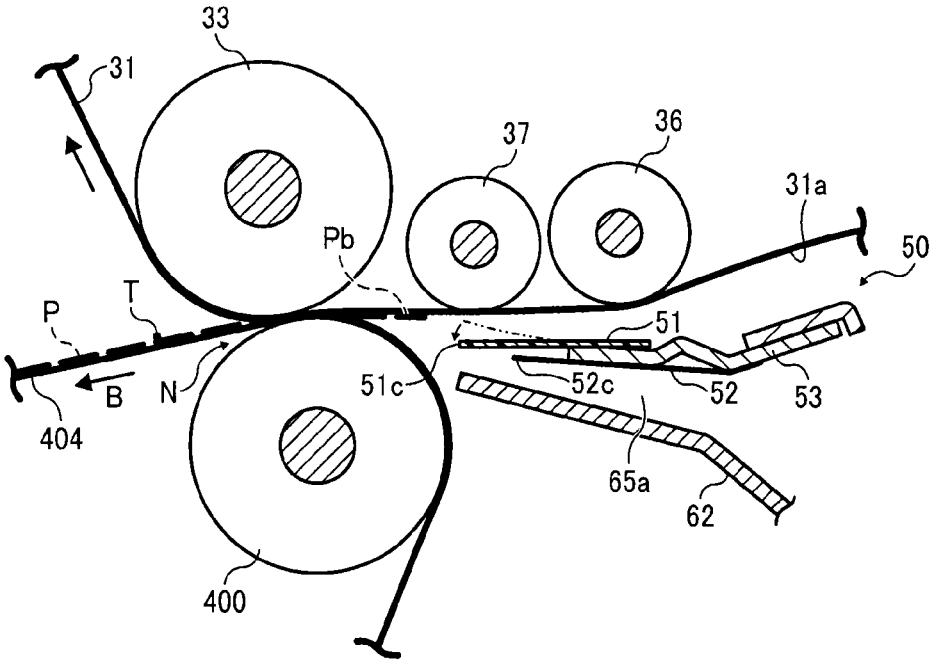
FIG. 8B is an enlarged view of a state in which the trailing end of the strong recording medium has passed the first guide.

The warping of the trailing end Pb of the recording medium P at the first guide 51 is reduced by deformation of the second guide 52 than when the trailing end Pb of the recording medium P arrives at the lower portion of the guide unit 50, thus moderating the restoring action. In such a state, when the recording medium P moves in the delivery direction B, the first guide 51 elastically deforms in a direction to approach the intermediate transfer belt 31. Accordingly, after the trailing end Pb passes below the first guide 51, as illustrated in FIG. 8B, the trailing end Pb moves away from the first guide 51 at a position relatively close to the front surface 31*a* of the intermediate transfer belt 31 and contacts the front surface 31*a*. Such a configuration allows the trailing end Pb of the recording medium P from contacting the front surface 31*a* after the flipping force of the trailing end Pb toward the front surface 31*a* is weakened, thus moderating the contact of the front surface 31*a* with the trailing end Pb of the recording medium P. In other words, the movement of the recording medium P from the second guide 52 to the front surface 31*a* of the intermediate transfer belt 31 is stepwisely and smoothly performed. Such a configuration moderates the contact of the trailing end Pb of the recording medium P having passed the first guide 51 with the front surface 31*a*, thus reliably preventing occurrence of an abnormal image on the recording medium P.

If the first guide 51 is heavily bent and contacts the front surface 31*a*, the roller 37 disposed inside the loop of the intermediate transfer belt 31 prevents the intermediate transfer belt 31 from being shifted toward the inside of the loop. Accordingly, vibration of the intermediate transfer belt 31 is reduced, thus more reliably preventing occurrence of an abnormal image on the recording medium P.

Figure 9A:
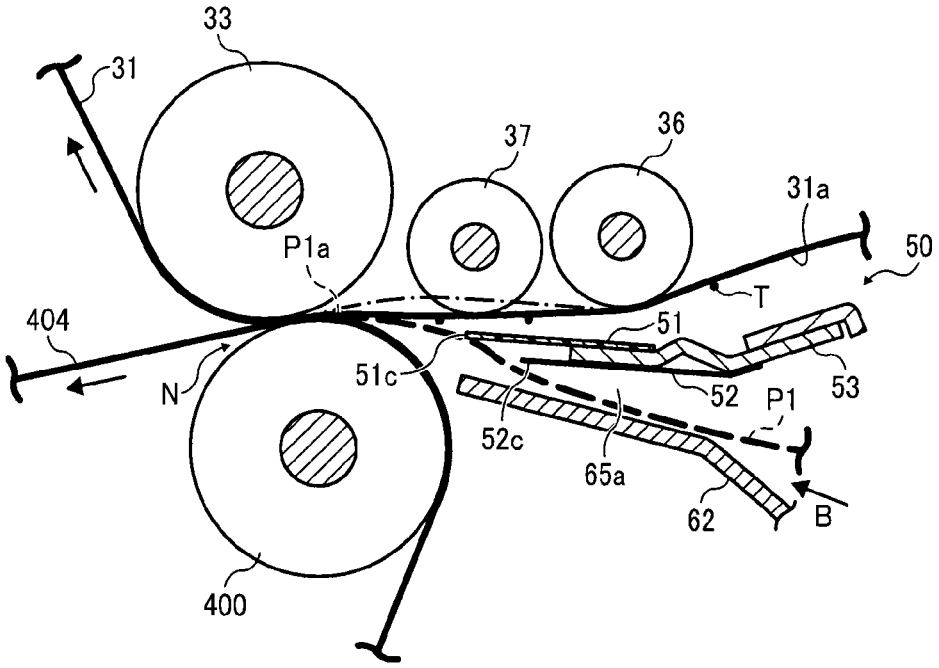
FIG. 9A is an enlarged view of a state in which a leading end of a weak recording medium has passed the first guide and the second guide.

As illustrated in FIG. 9A, the thin recording medium P1 of a lower basis weight is fed to the pre-nip delivery path 65*a* between the lower guide 62 and the guide unit 50. In such a case, depending on a delivery state, the leading end P1*a* of the thin recording medium P1 may pass the pre-nip delivery path 65*a* after contacting the leading end 51*c* of the first guide 51 without contacting the leading end 52*c* of the second guide 52, which is disposed more upstream in the delivery direction B. The leading end P1*a* passes the guide unit 50 and contacts the front surface 31*a* of the intermediate transfer belt 31 between the roller 37 and the secondary transfer nip N. By the contact, the leading end P1*a* might push up the intermediate transfer belt 31 toward the inside of the belt loop and cause vibration of the intermediate transfer belt 31. In this embodiment, however, the roller 37 prevents the intermediate transfer belt 31 from being pushed up toward the inside of the loop of the intermediate transfer belt 31. The leading end 51*c* of the first guide 51 is disposed perpendicular to the delivery direction B in plan view. Accordingly, when the recording medium P1 passes below the leading end 51*c* of the first guide 51, the leading end 51*c* evenly contacts the recording medium P1 and is guided to the secondary transfer nip N, thus allowing stable entry of the leading end P1*a* of the recording medium P1 to the secondary transfer nip N.

As the leading end P1*a* of the recording medium P1 enters the secondary transfer nip N, the recording medium P1 more warps. However, the first guide 51 has a desired hardness, thus preventing the first guide 51 from being excessively bent toward the intermediate transfer belt 31. Accordingly, since the contact of the front surface 31*a* with the first guide 51 is prevented, the vibration of the intermediate transfer belt 31 is reduced, thus preventing occurrence of an abnormal image due to disturbance of a toner image borne on the front surface 31*a*.

Figure 9B:
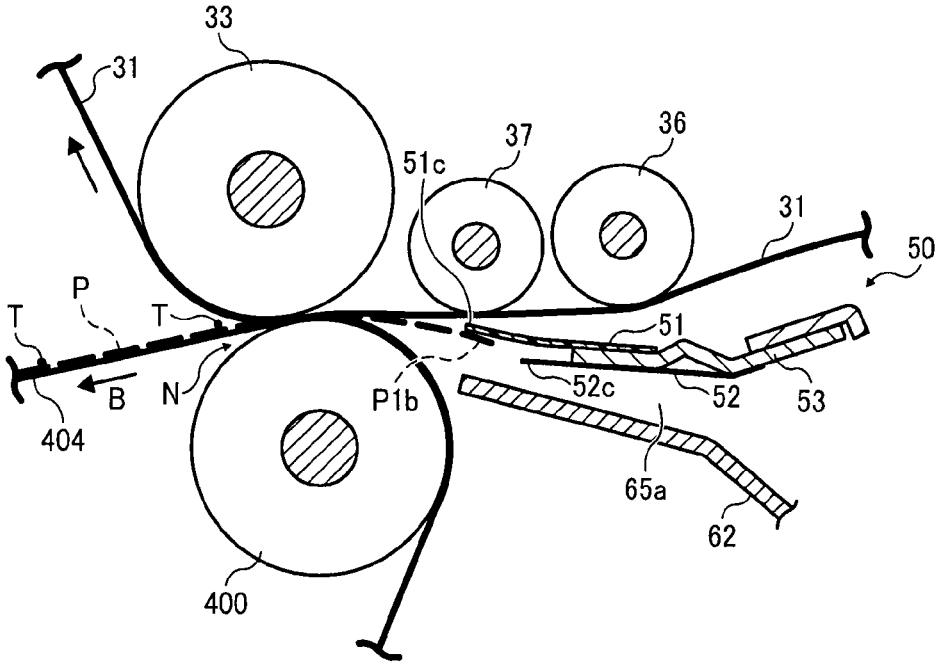
FIG. 9B is an enlarged view of a state in which a trailing end of the weak recording medium passes the second guide.

When the recording medium P is further delivered, the leading end Pa is guided into the secondary transfer nip N. The front surface 31*a* of the intermediate transfer belt 31 and the recording medium P tightly contact each other and enter the secondary transfer nip N. As illustrated in FIG. 9B, when the trailing end P1*b* of the recording medium P1 arrives at a lower portion of the guide unit 50, the trailing end P1*b* of the recording medium P1 moves while contacting the second guide 52. The second guide 52 is formed to be more easily bent, thus moderating the restoring action of the trailing end P1*b* of the recording medium P1 to return from the warping state into a flat state. Additionally, the second guide 52 is disposed away from the first guide 51, which is disposed above the second guide 52, at the predetermined gap D1 allowing deformation of the second guide 52. Accordingly, the second guide 52 can be sufficiently bent by the designed deformation amount, thus absorbing a restoration force of the trailing end P1*b* to return to the flat state.

Figure 10A:
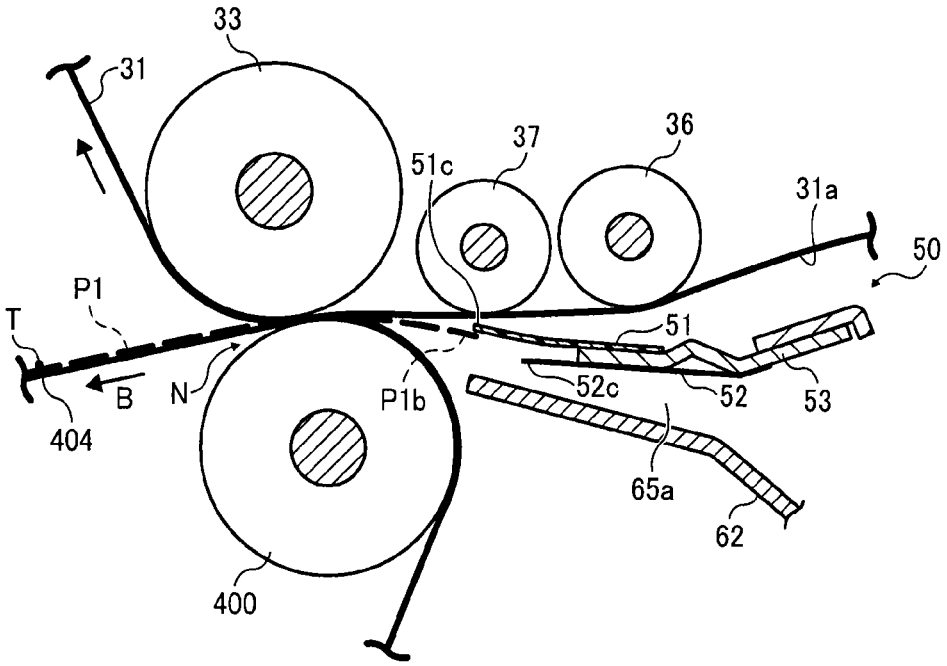
FIG. 10A is an enlarged view of a state in which the trailing end of the weak recording medium has moved from the second guide to the first guide.

The leading end 52*c* of the second guide 52 is disposed to be inclined relative to the delivery direction B in an area from the end 52*a* to the other end 52*b* in the lateral direction X. In other words, the leading end 52*c* of the second guide 52 is inclined so that a projecting amount t1 of the end 52*a* beyond the downstream end 53*c* is greater than a projecting amount t2 of the other end 52*b* beyond the downstream end 53*c*. Accordingly, as the recording medium P1 is delivered in the delivery direction B, the contact area of the second guide 52 with the recording medium P1 increases, thus moderating deformation of the second guide 52 toward the first guide 51. Thus, as illustrated in FIG. 10A, the trailing end P1*b* of the recording medium P1 smoothly moves to the first guide 51.

Figure 10B:
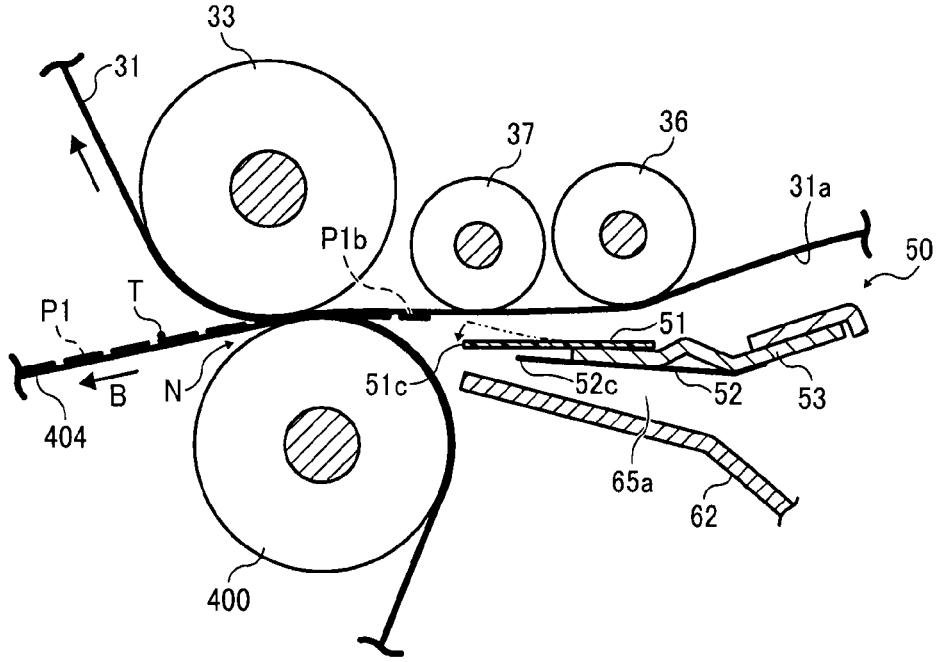
FIG. 10B is an enlarged view of a state in which the trailing end of the weak recording medium has passed the first guide.

The warping of the trailing end P1*b* of the recording medium P1 at the first guide 51 is reduced by deformation of the second guide 52 than when the trailing end Pb of the recording medium P arrives at the lower portion of the guide unit 50, thus moderating the restoring action. In such a state, when the recording medium P1 moves in the delivery direction B, the first guide 51 elastically deforms in a direction to approach the intermediate transfer belt 31. Accordingly, after the trailing end P1*b* passes below the first guide 51, as illustrated in FIG. 10B, the trailing end P1*b* moves away from the first guide 51 at a position relatively close to the front surface 31*a* of the intermediate transfer belt 31 and contacts the front surface 31*a*. Such a configuration allows the trailing end P1*b* of the recording medium P1 from contacting the front surface 31*a* after the flipping force of the trailing end P1*b* toward the front surface 31*a* is weakened, thus moderating the contact of the front surface 31*a* with the trailing end P1*b* of the recording medium P1. In other words, the movement of the recording medium P1 from the second guide 52 to the front surface 31*a* of the intermediate transfer belt 31 is stepwisely and smoothly performed. Such a configuration moderates the contact of the trailing end P1*b* of the recording medium P1 having passed the first guide 51 with the front surface 31*a*, thus reliably preventing occurrence of an abnormal image on the recording medium P1. The recording medium P1 is weaker and has a lower restoring force. Accordingly, the amount of deformation of the first guide 51 by the recording medium P1 is smaller than the recording medium P, and the contact of the trailing end P1*b* of the recording medium P1 having passed the first guide 51 with the front surface 31*a* is weaker than the contact of the trailing end Pb of the recording medium P. Such a configuration reliably prevents occurrence of an abnormal image on the recording medium P1.

Variation 1

Figure 11:
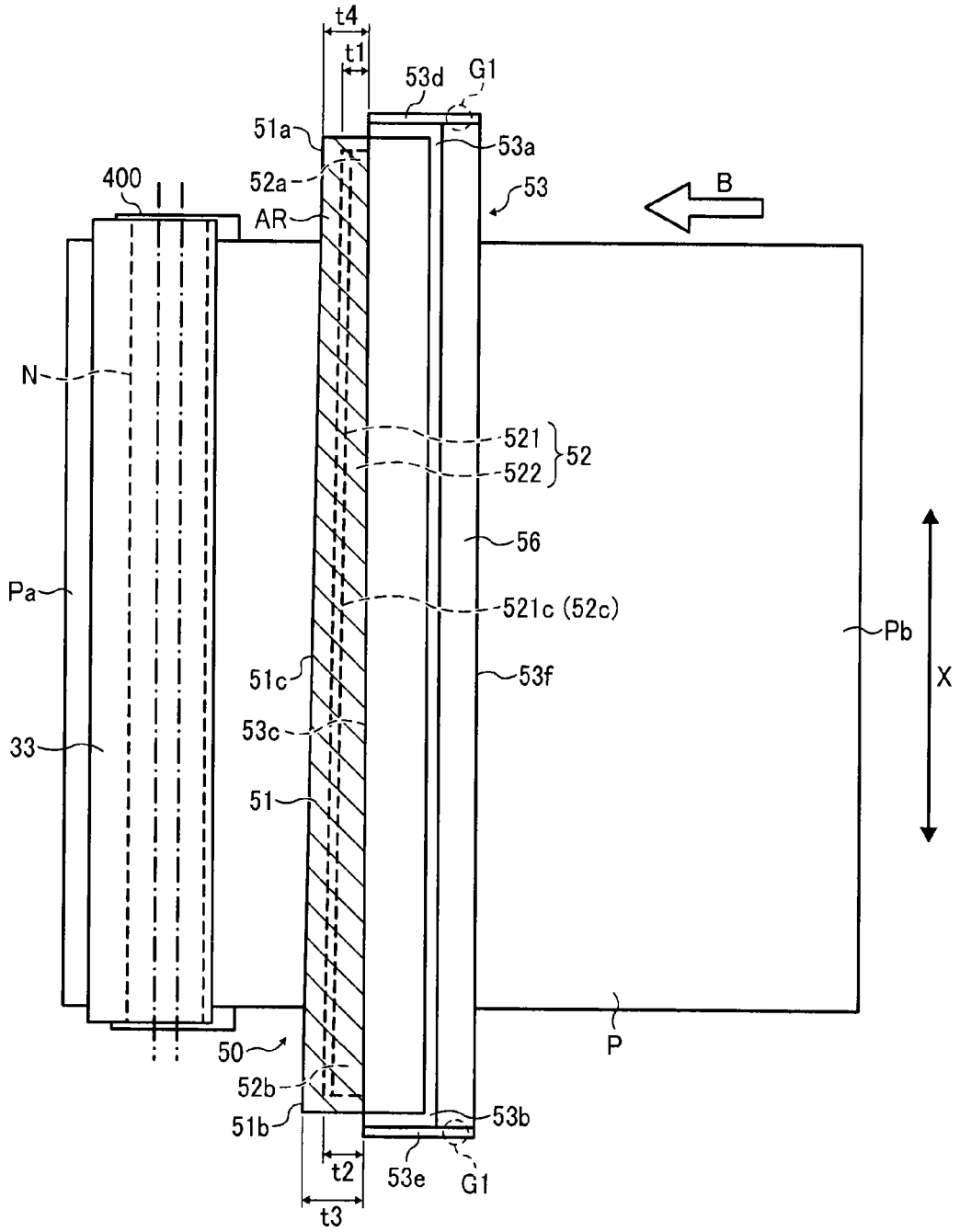
FIG. 11 is a plan view of the configuration and arrangement of a first guide and a second guide according to variation 1 with different mount angles from those of FIG. 3.

In the above-described embodiment, the first guide 51 is disposed so that the leading end 51*c* is perpendicular to the delivery direction B in plan view. However, as illustrated in FIG. 11, the leading end 51*c* may be inclined so that a projecting amount t3 of the end 51*b* beyond the downstream end 53*c* is greater than a projecting amount t4 of the end 51*a* beyond the downstream end 53*c*. In such a case, the leading end 51*c* may be parallel to the leading end 52*c* of the second guide 52. The difference between the projecting amount t3 and the projecting amount t4 may be relatively small so that the inclination of the leading end 51*c* is more moderate than the leading end 52*c*.

Variation 2

Figure 12:
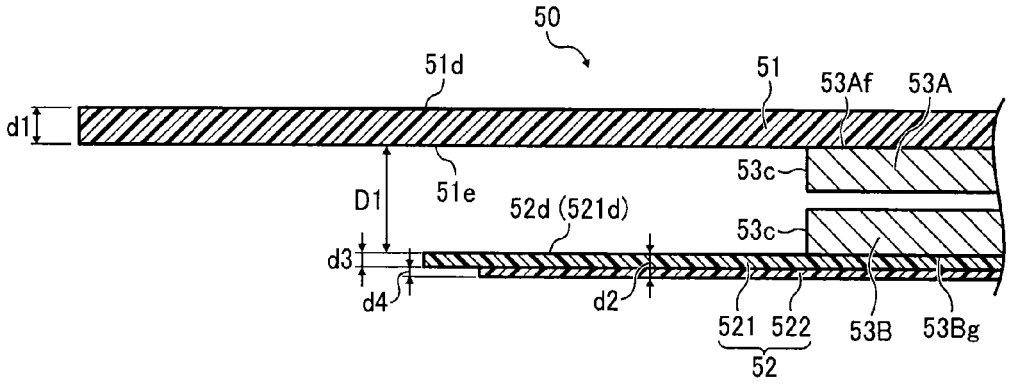
FIG. 12 is an enlarged cross-sectional view of the configuration of variation 2 in which a first guide and a second guide are separately supported.

The first guide 51 and the second guide 52 may be commonly mounted on the mount 53. However, as illustrated in FIG. 12, a mount 53A and a mount 53B may be separately disposed so that the first guide 51 is mounted on an upper face 53Af serving as a mount face of the mount 53A and the second guide 52 is mounted on a lower face 53Bg serving as a mount face of the mount 53B. In such a case, the first guide 51 and the second guide 52 are preferably mounted away from each other to maintain the predetermined gap D1 to allow smooth movement of the recording media P and P1 from the second guide 52 to the first guide 51.

Variation 3

Figure 13:
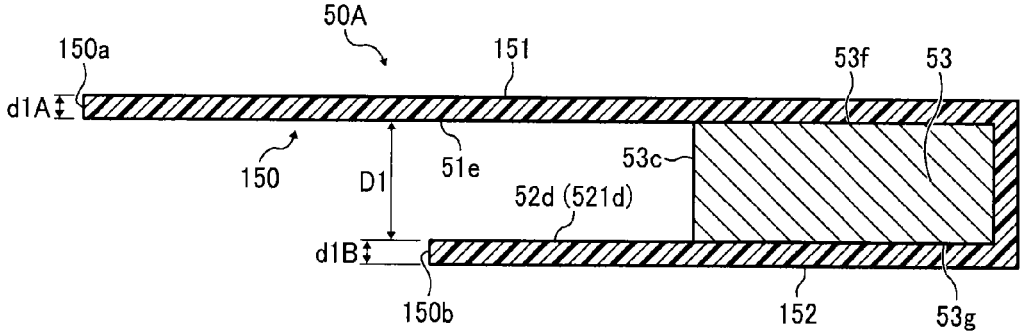
FIG. 13 is an enlarged cross-sectional view of the configuration of variation 3 in which a first guide and a second guide are made of a single member.

The first guide 51 and the second guide 52 may be made of separate films. However, as illustrated in FIG. 13, the first guide 51 and the second guide 52 may be formed by bending a single film 150. In such a case, the film 150 is wrapped around the mount 53 across the upper face 53*f* and the lower face 53*g*, and attached to the upper face 53*f* and the lower face 53*g*. Each of ends 150*a* and 150*b* of the film 150 in the delivery direction B projects beyond the downstream end 53*c* in the delivery direction B. The end 150*a* at the upper face 53*f* side is formed straight so as to be perpendicular to the delivery direction B. The end 150*b* at the lower face 53*g* side is inclined with respect to the lateral direction and shifted upstream from the end 150*a* in the delivery direction B. Thus, a guide unit 50A includes a first guide 151 and a second guide 152. In such a case, the thickness d1A of the first guide 151 is equal to the thickness d1B of the second guide 152. Accordingly, as the reference of thickness, the film 150 having the thickness d2 of the second guide 52 is preferably used to achieve the function of the second guide 152. As described above, even when the single film 150 constitutes the first guide 151 and the second guide 152, the movement of the recording medium P or P1 between the first guide 151 and the second guide 152 is smoothly performed with a simple configuration.

Variation 4

Figure 14:
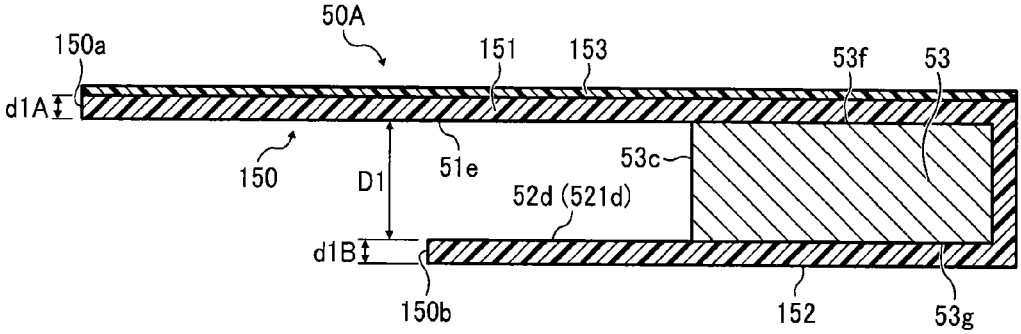
FIG. 14 is an enlarged cross-sectional view of the configuration of variation 4 in which a first guide has a lamination structure.

To enhance the hardness of the first guide 151, as illustrated in FIG. 14, another seal 153 may be laminated on the first guide 151.

Next, a description is given of the dimension of the guide unit 50 in this embodiment.

In this embodiment, the gap GP of the opposing face 51*d* of the first guide 51 and the front surface 31*a* of the intermediate transfer belt 31 is disposed within a range of 0.5 mm to 2 mm from the front surface 31*a*. For the second guide 152, the projecting amount of the other end 52*b* beyond the end 52*a* is not greater than 5 mm. The predetermined gap D1 between the first guide 51 and the predetermined gap D1 is not greater than 2 mm. The thickness d1 of the first guide 51 is 0.35 mm in consideration of the hardness and the contact with the front surface 31*a* of the intermediate transfer belt 31. The thickness d1 can be greater. However, if the thickness d1 is greater, the first guide 51 would be closer to the front surface 31*a* and might contact the front surface 31*a*. Therefore, in consideration of the balance between the thickness and the gap GP, the thickness d1 is set to be 0.35 mm. The thickness d2 of the second guide 52 is not limited to 0.35 mm. However, if the thickness d2 is relatively smaller, the second guide 52 would have a relatively lower hardness and might be broken by contact with the recording medium P or P1. Accordingly, in consideration of endurance, the thickness d2 of the second guide 52 is set to be at least 0.125 mm. Such a thickness prevents breakage of the second guide 52 and causes the second guide 52 to be sufficiently bent, thus allowing smooth movement of the recording medium P from the second guide 52 to the first guide 51. The degree of bending and the contact state of each of the first guide 51 and the second guide 52 vary with the delivery speed of recording media. Therefore, the above-described test of the thickness d2 of the second guide 52 is conducted with a maximum delivery speed of recording media in a test apparatus.

In delivery, typically, the strong recording medium P, a thick sheet of paper, contacts both the first guide 51 and the second guide 52, and the weak recording medium P1, a thin sheet of paper, contacts only the first guide 51 or the second guide 52. However, when the thin recording medium P1 is conveyed at a high speed, the thin recording medium P1 may contact both the first guide 51 and the second guide 52. Accordingly, recording media to contact and be guided with the first guide 51 and the second guide 52 are not limited to thick sheets of paper and thin sheets of paper, and any suitable types of recording material to be delivered toward the secondary transfer nip N. In this embodiment and the variations, the first guide 51 and the second guide 52 are made of resin film(s). Note that, since the first guide 51 does not necessarily need bendability, the first guide 51 may be made of a single metal plate, instead of the resin film(s).

Variation 5

Figure 17:
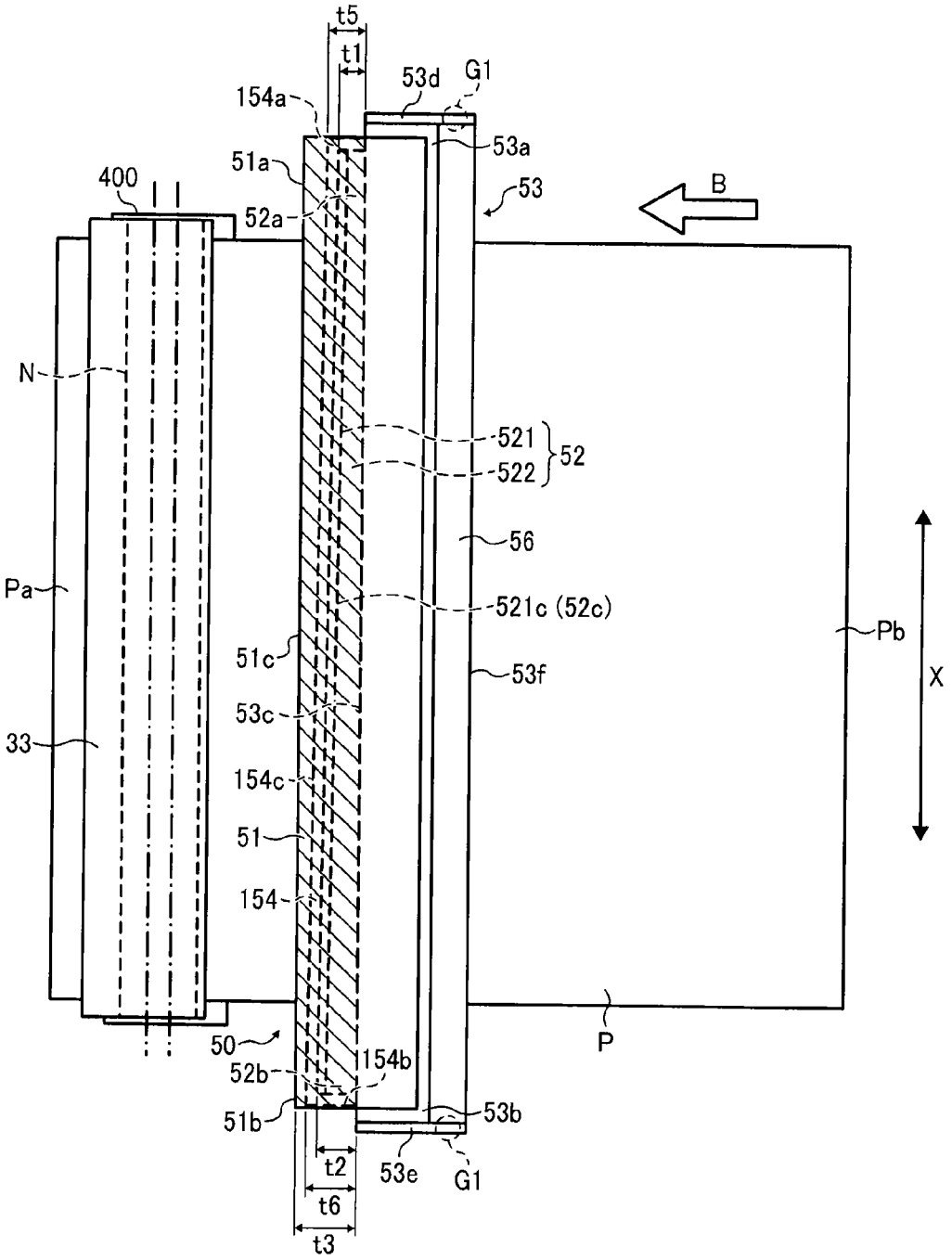
FIG. 17 is a plan view of the configuration and arrangement of variation 5 in which a first guide has a lamination structure.
Figure 18:
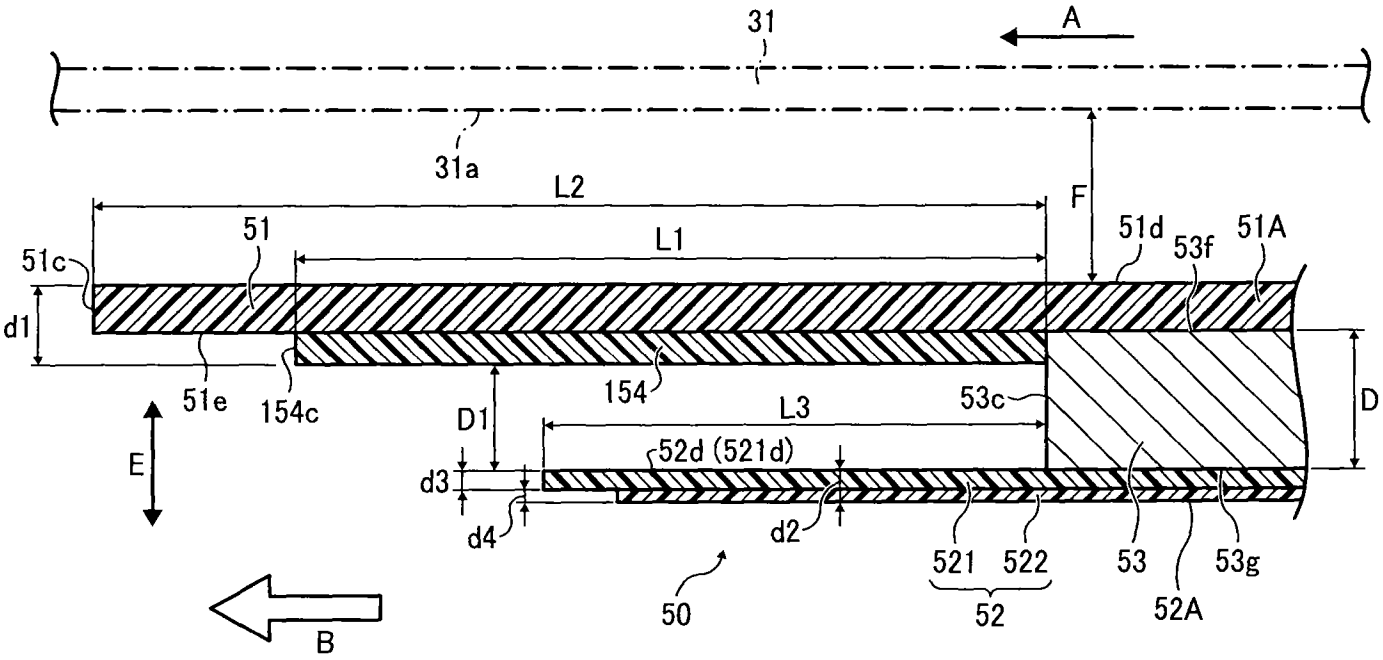
FIG. 18 is an enlarged cross-sectional view of the configuration of variation 5.

In this variation 5, as illustrated in FIGS. 17 and 18, the thickness d1 of the first guide 51 is partially increased between the first guide 51 and the second guide 52. In this variation, the first guide 51 is laminated with a sheet 154 by attaching the sheet 154 on the back face 51*e* of the first guide 51 disposed between the first guide 51 and the second guide 52. Thus, the thickness d1 of the first guide 51 is partially increased. The sheet 154 projects from the downstream end 53*c* of the mount 53 to the secondary transfer nip N, and is attached on the back face 51*e* of a portion of the first guide 51 projecting from the downstream end 53*c* of the mount 53. As illustrated in FIG. 18, a leading end 154*c* of the sheet 154 is disposed between the leading end 51*c* of the first guide 51 and the leading end 52*c* of the second guide 52. A projecting amount L1 of the sheet 154 from the downstream end 53*c* of the mount 53 to the leading end 154*c* of the sheet 154 is shorter than a projecting amount L2 of the first guide 51 from the downstream end 53*c* of the mount 53 to the leading end 51*c* of the first guide 51, and is longer than a projecting amount L3 of the second guide 52 from the downstream end 53*c* to the leading end 52*c*. The projecting amount L1 is a relative projecting amount of the entire sheet 154, which is different from a partial projecting amount t5 or t6. As illustrated in FIG. 17, the leading end 154*c* of the sheet 154 is angled relative to the delivery direction B. The sheet 154 is attached to the back face 51*e* of the first guide 51 with, e.g., a double-sided adhesive tape so that the leading end 154*c* extending in the lateral direction X is inclined from one end 154*a* to the other end 154*b* in the lateral direction X. The leading end 154*c* of the sheet 154 is inclined so that a projecting amount t6 of the end 154*b* beyond the downstream end 53*c* is greater than a projecting amount t5 of the end 154*a* beyond the downstream end 53*c*. In other words, in this variation, the leading end 154*c* of the sheet 154 is inclined relative to the leading end 51*c* of the first guide 51.

As described above, in the configuration in which the sheet 154 is additionally disposed on the back face 51*e* of the projecting portion of the first guide 51, the predetermined gap D1 between the first guide 51 and the second guide 52 can be set to an optimal size, regardless of the thickness D of the mount 53, Accordingly, the recording medium P is more smoothly delivered to the first guide 51. Further, adding the sheet 154 increases the thickness of the projecting portion of the first guide 51 and enhances the hardness of the first guide 51. Such a configuration more reliably maintains the gap GP between the front surface 31*a* of the intermediate transfer belt 31 and the opposing face 51*d* of the first guide 51 (the distance between the intermediate transfer belt 31 and the first guide 51). Furthermore, the arrangement of the leading end 154*c* of the sheet 154 angled relative to the delivery direction B allows smooth movement of a recording medium P from the first guide 51 to the intermediate transfer belt 31.

Figure 19:
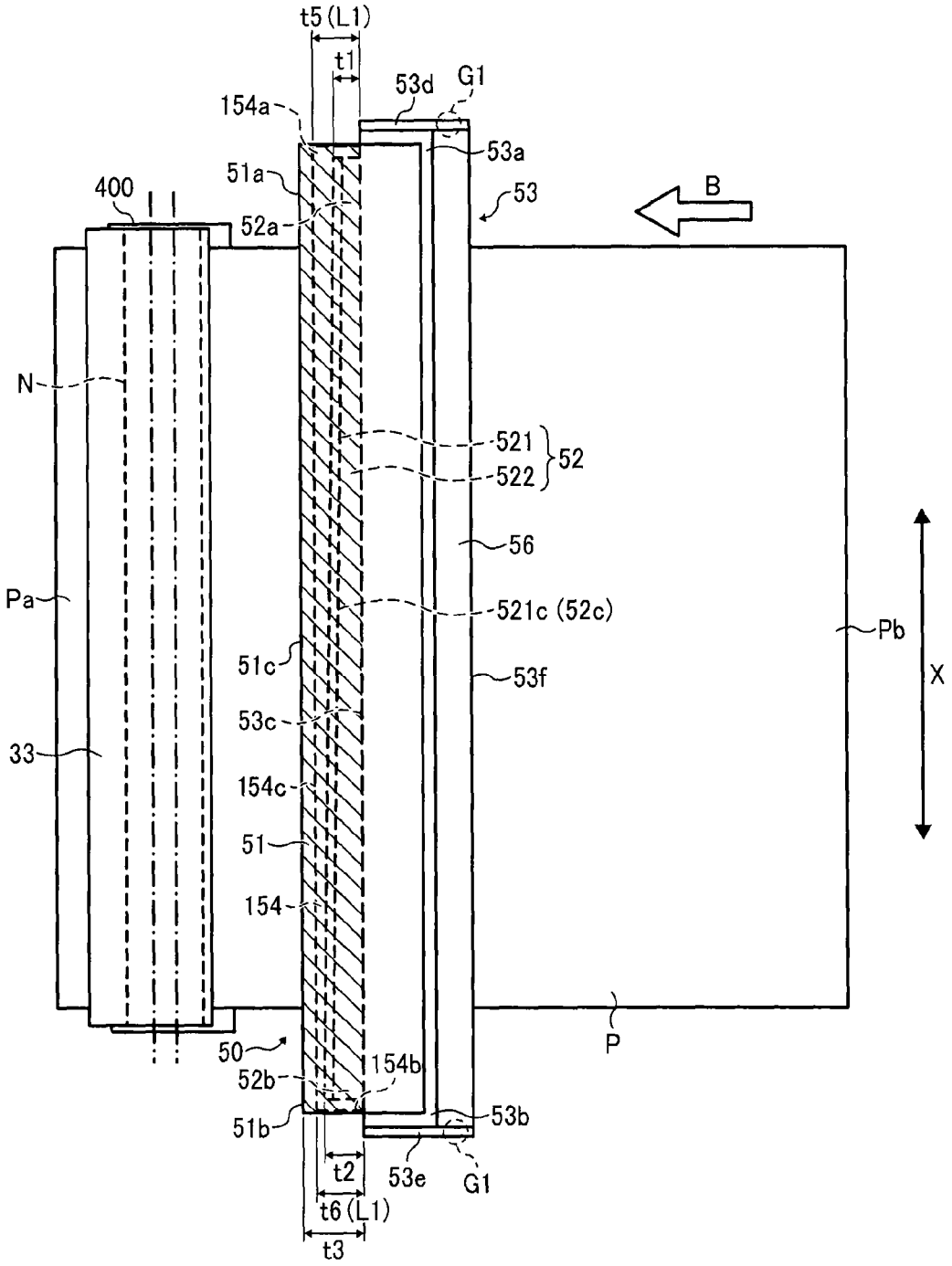
FIG. 19 is a plan view of an example of variation 5 in which a leading end of a sheet is disposed perpendicular to a delivery direction of a recording medium.

Alternatively, as illustrated in FIG. 19, the leading end 154*c* of the sheet 154 may be disposed along the lateral direction X perpendicular to the delivery direction B of the recording medium P. In other words, the leading end 154*c* of the sheet 154 may be attached to the back face 51*e* of the first guide 51 with, e.g., a double-sided adhesive tape so as to be perpendicular to the delivery direction B from the end 154*a* to the other end 154*b* in the lateral direction X in plan view. In other words, in FIG. 19, the leading end 154*c* of the sheet 154 is disposed parallel to the leading end 51*c* of the first guide 51 so that the projecting amount t5 of the end 154*a* from the downstream end 53*c* is equal to the projecting amount to of the other end 154*b* from the downstream end 53*c*. With such a configuration, the predetermined gap D1 between the first guide 51 and the second guide 52 can be set to an optimal size, regardless of the thickness D of the mount 53, thus allowing a recording medium P to smoothly move to the first guide 51. Further, adding the sheet 154 increases the thickness of the projecting portion of the first guide 51 and enhances the hardness of the first guide 51. Such a configuration more reliably maintains the gap GP between the front surface 31*a* of the intermediate transfer belt 31 and the opposing face 51*d* of the first guide 51 (the distance between the intermediate transfer belt 31 and the first guide 51).

Variation 6

Figure 20:
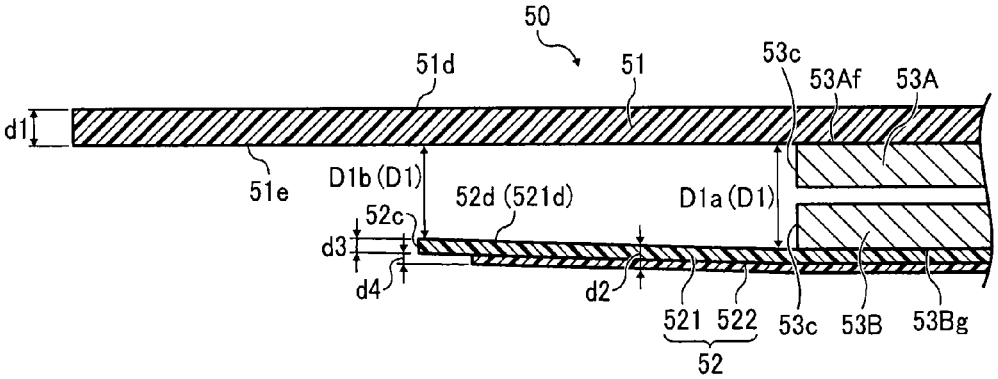
FIG. 20 is an enlarged cross-sectional view of the configuration of variation 6 in which a second guide approaches a first guide toward a leading end of the second guide.

In this variation, as illustrated in FIG. 20, the guide unit 50 has a configuration in which the second guide 52 approaches the first guide 51 as the position in the second guide 52 is closer to the leading end 52*c*. A basic configuration of this variation is the configuration of variation 2 in which the first guide and the second guide are separately supported. Of the predetermined gap D1 in a space between the first guide 51 and the second guide 52 (the upper face 521*d* of the sheet 521), a predetermined gap D1*a* at the side of the mounts 53A and 53B differs from a predetermined gap D1*b* at the side of the leading end 52*c*. More specifically, the predetermined gap D1 becomes smaller as it approaches the leading end 52*c* (the predetermined gap D1*a*>the predetermined gap D1*b*).

Figure 21:
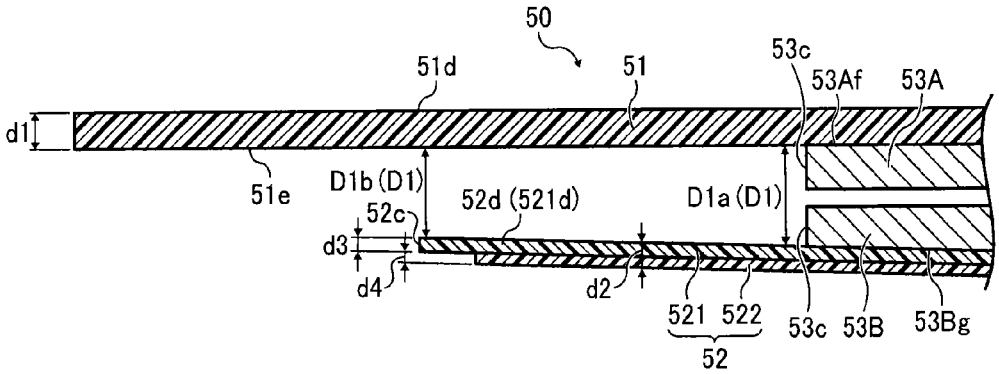
FIG. 21 is an enlarged cross-sectional view of a variation of the way in which a second guide approaches a first guide toward a leading end of the second guide.

As a method of decreasing the predetermined gap D1 toward the leading end 52*c* (the predetermined gap D1*a*>the predetermined gap D1*b*), for example, the guide unit 50 is formed by bending a portion of the second guide 52 close to the leading end 52*c* toward the first guide 51. In another method, for example, as illustrated in FIG. 21, a lower face 53Bg serving as a mount face of the mount 53B on which the second guide 52 (the sheet 521) is mounted is formed to be a slant face upwardly approaching the first guide 51 toward the downstream end 53*c* of the mount 53. An end 52A of the second guide is attached to the lower face 53Bg being the slant face, thus allowing the second guide 52 to approach the first guide 51 toward the leading end 52*c*. In other words, the lower face 53Bg of the mount 53B on which the second guide 52 is mounted is inclined relative to the upper face 53Af serving as a mount face of the mount 53A on which the first guide 51 is mounted.

As described above, the configuration in which the second guide 52 approaches the first guide 51 toward the leading end 52*c* allows the recording medium P to be smoothly delivered from the second guide 52 to the first guide 51. As described above, this variation employs the configuration of variation 2. Note that, in other variations, the second guide 52 may be formed by any suitable method so as to approach the first guide 51 toward the leading end 52*c*.

Figure 22:
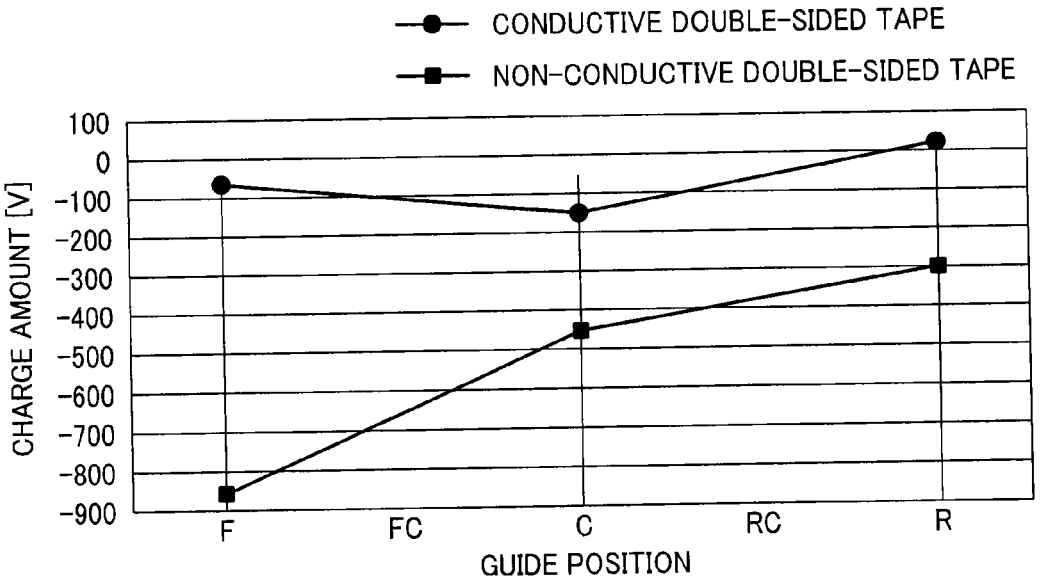
FIG. 22 is a graph of comparison results of charge amounts of a guide between a case in which the guide is joined to a base with a conductive member and a case in which the guide is joined to the base with a non-conductive member.

FIG. 22 is a graph of charge amounts of a guide after passage of a certain number of recording media. In FIG. 22, the vertical axis represents charge amount (V) and the horizontal axis represents positions of a guide plate. FIG. 22 shows results of comparison of the case in which the first guide 51 is joined with the mount 53 via a conductive double-sided adhesive tape 57 and the case in which the first guide 51 is joined with the mount 53 via a non-conductive double-sided adhesive tape 58. Round marks in FIG. 22 represent characteristics of the case with the conductive double-sided adhesive tape 57. Square marks in FIG. 22 represent characteristics of the case with the non-conductive double-sided adhesive tape 58. In FIG. 22, the term "guide position" represents the position of the first guide 51 in the lateral direction X (see FIG. 3). In FIG. 22, F represents a front side position of the first guide 51 on which a recording medium P passes (the end 51*b* side of FIG. 3), R represents a rear side position of the first guide 51 on which a recording medium P passes (the end 51*a* side of FIG. 3), and C represents a center position of the first guide 51 on which a recording medium P passes (a middle position between the end 51*a* and the end 51*b* of FIG. 3). FC represents a position between the end 51*b* and the center position, and RC represents a position between the end 51*a* and the center position. Each of F and R represents a position inner than a lateral end of the recording medium P by approximately 10 mm to approximately 50 mm. The position values of F and R are indexes, and any suitable values within a range in which the recording medium P passes. The charge amount of the first guide 51 is preferably smaller to prevent Image failure due to electric discharge. From the comparison results, it is found that, in the case with the conductive double-sided adhesive tape 57, the charge amount of the first guide 51 is smaller than in the case with the non-conductive double-sided adhesive tape 58.

As described above, in this embodiment, for the arrangement of the conductive member, the double-sided adhesive tape 57 made of the conductive member is disposed so as not to spread over the joined face of the mount 53 with the first guide 51. Accordingly, even when the recording medium P contacts the first guide 51, the recording medium P does not contact the double-sided adhesive tape 57. Such a configuration prevents the recording medium P from being damaged and the first guide 51 from being charged by friction, thus preventing occurrence of an abnormal image without damage to the recording medium P. In this embodiment, the guide unit 50 having such a configuration is disposed upstream from the secondary transfer nip N in the delivery direction B of the recording medium P so as to oppose the front surface 31*a* of the intermediate transfer belt 31, thus regulating movement of the recording medium P delivered to the secondary transfer nip N. In this embodiment, the guide unit 50 includes the first guide 51 and the second guide 52 to guide the recording medium P delivered to the secondary transfer nip N. The second guide 52 is disposed upstream from the first guide 51 in the delivery direction B. The conductive double-sided adhesive tape 57 is used to join the first guide 51 with the mount 53. Such a configuration prevents occurrence of an abnormal image at low cost without damaging the recording medium P even when the recording medium P contacts the first guide 51.

In delivery, typically, the strong recording medium P, a thick sheet of paper, contacts both the first guide 51 and the second guide 52, and the weak recording medium P1, a thin sheet of paper, contacts only the first guide 51 or the second guide 52. However, when the thin recording medium P1 is conveyed at a high speed, the thin recording medium P1 may contact both the first guide 51 and the second guide 52. Accordingly, recording media to contact and be guided with the first guide 51 and the second guide 52 are not limited to thick sheets of paper and thin sheets of paper, and any suitable types of recording material to be delivered toward the secondary transfer nip N.

In this embodiment, the first guide 51 and the second guide 52 are made of resin film(s). Note that, since the first guide 51 does not necessarily need bendability, the first guide 51 may be made of a single non-conductive plate, instead of the resin film(s).

Figure 23:
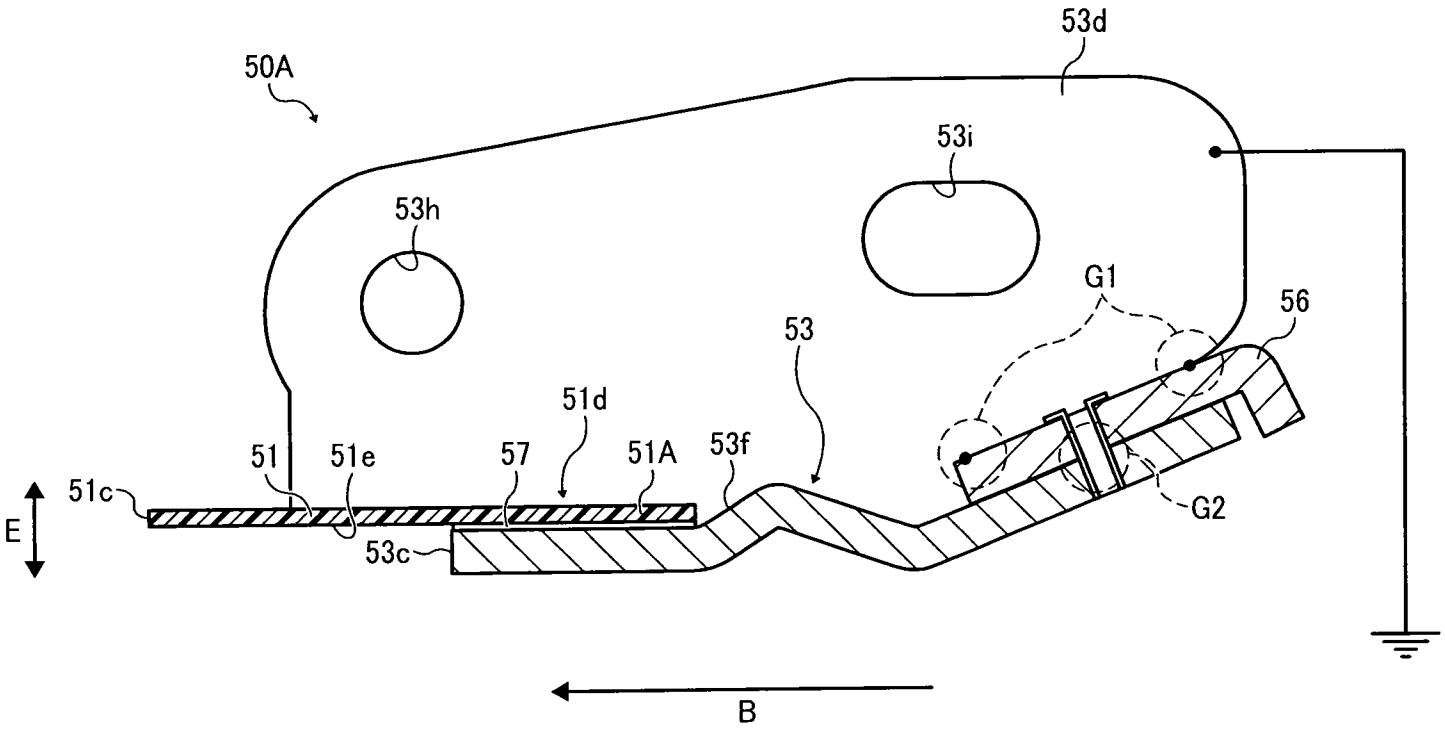
FIG. 23 is a cross-sectional view of the configuration of a variation of a guide unit.

For the guide unit 50 described in the above-described embodiment, when the recording medium P is a thick sheet of paper, the two guides, the first guide 51 and the second guide 52, are attached and joined to the upper side and the lower side of the mount 53. However, applicable embodiments of the present disclosure are not limited to the embodiments employing the plurality of guides. For example, as illustrated in FIG. 23, a conveyance guide may be a guide unit 50A in which, without a second guide 52, only a first guide 51 is joined to an upper face 53*f* of a mount 53 with a conductive double-sided adhesive tape 57. In such a case, instead of the guide unit 50, the guide unit 50A is disposed upstream from a secondary transfer nip N in a delivery direction B of a recording medium P. Even when the recording medium P contacts the first guide 51, such a configuration prevents occurrence of an abnormal image without damaging the recording medium P.

Figure 15:
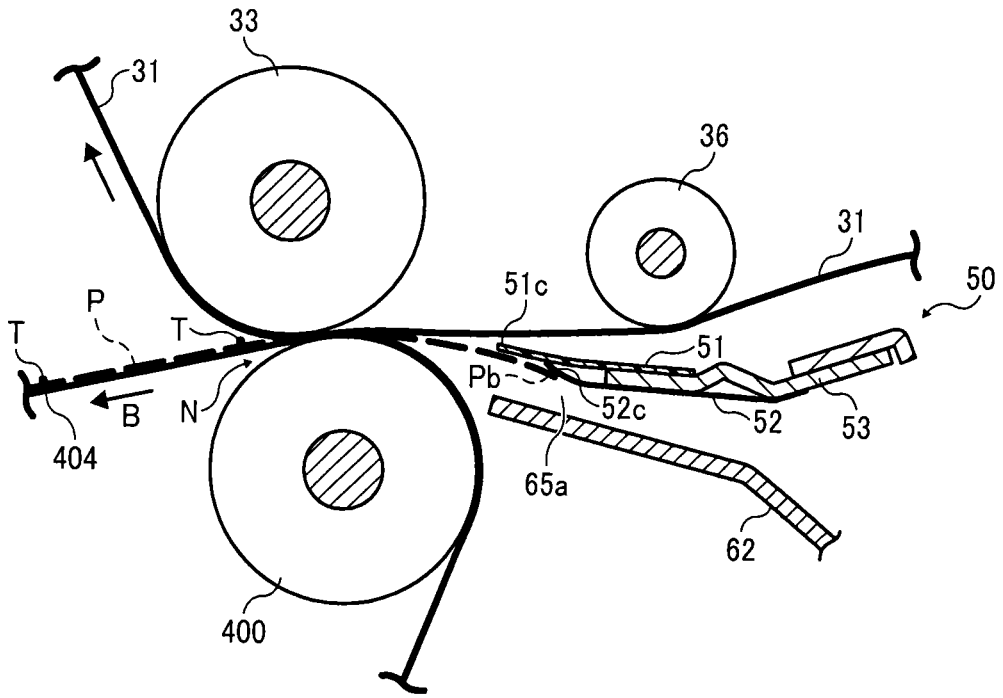
FIG. 15 is an enlarged view of another variation of the present disclosure.

Although the embodiments of the present disclosure have been described above, the present disclosure is not limited to the embodiments described above, but a variety of modifications can naturally be made within the scope of the present disclosure. For example, the image forming apparatus is not limited to a color copier, and may be, e.g., a printer, a facsimile machine, or a plotter printer. The image forming apparatus may also be a multifunction peripheral having at least two of a scanner, a printer, a facsimile machine, a plotter printer, and a copier. In this embodiment, the roller 36 and the roller 37 serving as two rotators are disposed inside the loop of the intermediate transfer belt 31 so as to oppose the first guide 51 of the guide unit 50. Accordingly, even when the leading end Pb of the recording medium P contacts the front surface 31*a* of the intermediate transfer belt 31 at a position upstream from the secondary transfer nip N in the delivery direction B, such a configuration more reliably prevents the intermediate transfer belt 31 from being pushed up toward the inside of the loop of the intermediate transfer belt 31. However, the configuration of each of the guide units 50 and 50A according to the above-described embodiments and variations is applicable to a configuration illustrated in FIG. 15 without the roller 37, thus giving operation effects obtained by the configurations of the guide units 50 and 50A.

In the above descriptions, the image forming apparatus according to any of the above-described embodiments transfers images from the intermediate transfer belt 31 onto a recording medium P. Instead of such an image forming apparatus employing an intermediate transfer system, for example, the present invention is applicable to an apparatus (an image forming apparatus of a direct transfer system that directly transfers an image from an image bearer, such as a photoconductor drum or a photoconductor belt, onto a recording medium P. In the above-described embodiments, the secondary transfer belt 404 is employed as a transferer. Alternatively, in some embodiments, instead of the secondary transfer belt 404, a secondary transfer roller may be employed as a transferer. The transfer section may be a transfer device of a system having no transfer nip (e.g., a transfer charger of a charging system). In the above-described embodiments, the image forming apparatus conveys a recording medium P in a horizontal direction in the transfer section (the secondary transfer nip N). However, embodiments of this disclosure are not limited to the configuration of horizontal conveyance. For example, the present invention is applicable to an image forming apparatus that conveys a recording medium P in a transfer section upward, downward, diagonally upward, or diagonally downward.

The above-described effects of the embodiments and variations are only examples of effects obtained from the present invention, and the effects of the present invention are not limited to those described in the above-described embodiments and variations.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearer having an image bearing face to bear an image thereon;

a transferer disposed opposing the image bearer, to transfer the image from the image bearing face onto a recording medium at a transfer section between the transferer and the image bearer;

a first guide disposed upstream from the transfer section in a direction of delivery of the recording medium, to guide the recording medium to the transfer section; and a second guide disposed upstream from the first guide in the direction of delivery of the recording medium and spaced away from the first guide, to guide the recording medium to the transfer section, each of the first guide and the second guide extending in a lateral direction perpendicular to the direction of delivery of the recording medium, a leading end of the second guide in the direction of delivery of the recording medium being inclined from one end to the other end of the second guide in the lateral direction, and the first guide and the second guide are disposed on a same side as the image bearer relative to a delivery path of the recording medium.

2. The image forming apparatus according to claim 1, wherein a leading end of the first guide is disposed perpendicular to the direction of delivery in plan view, and extends from one end to the other end of the first guide in the lateral direction.

3. The image forming apparatus according to claim 1, wherein an inclination of the first guide relative to the direction of delivery in plan view from one end to the other end of the first guide in the lateral direction is smaller than an inclination of the second guide relative to the direction of delivery in plan view from one end to the other end of the second guide in the lateral direction.

4. The image forming apparatus according to claim 1, wherein a projecting amount at which the other end of the second guide projects beyond the one end of the second guide in the direction of delivery is not greater than 5 mm.

5. The image forming apparatus according to claim 1, wherein the first guide includes an opposing face opposing the image bearing face of the image bearer, and the opposing face is disposed within a range from 0.5 mm to 2 mm from the image bearing face.

6. The image forming apparatus according to claim 1, wherein the first guide and the second guide are disposed opposing each other with a gap in a direction that opposes the image bearing face.

7. The image forming apparatus according to claim 6, wherein the gap is not greater than 2 mm.

8. The image forming apparatus according to claim 1, wherein each of the first guide and the second guide is made of a resin film.

9. The image forming apparatus according to claim 8, wherein a relation of d1≥d2 is satisfied, where d1 represents a thickness of the first guide and d2 represents a thickness of the second guide.

10. The image forming apparatus according to claim 1, further comprising a mount to mount an upstream end of each of the first guide and the second guide, wherein the mount is made of a plurality of metal members with a joined portion thereof welded.

11. The image forming apparatus according to claim 1, further comprising a mount to mount an upstream end of each of the first guide and the second guide, wherein the mount is made of a plurality of metal members with a joined portion thereof caulked.

12. An image forming apparatus, comprising:

an image bearer having an image bearing face to bear an image thereon;

a transferer disposed opposing the image bearer, to transfer the image from the image bearing face onto a recording medium at a transfer section between the transferer and the image bearer;

a first guide disposed upstream from the transfer section in a direction of delivery of the recording medium, to guide the recording medium to the transfer section; and a second guide disposed upstream from the first guide in the direction of delivery of the recording medium and spaced away from the first guide, to guide the recording medium to the transfer section, each of the first guide and the second guide extending in a lateral direction perpendicular to the direction of delivery of the recording medium, a leading end of the second guide in the direction of delivery of the recording medium being inclined from one end to the other end of the second guide in the lateral direction, and wherein a thickness of the first guide is partially increased between the first guide and the second guide.

13. The image forming apparatus according to claim 12, wherein the thickness of the first guide is partially increased by a sheet attached on a back face of the first guide between the first guide and the second guide.

14. The image forming apparatus according to claim 13, further comprising a mount to mount an upsteam end of each of the first guide and the second guide, wherein a leading end of the first guide and the leading end of the second guide in the direction of delivery of the recording medium projects from a downstream end of the mount toward the transfer section, and the sheet attached on the back face of the first guide projects from the downstream end of the mount toward the transfer section.

15. The image forming apparatus according to claim 14, wherein a leading end of the sheet is disposed between the leading end of the first guide and the leading end of the second guide.

16. The image forming apparatus according to claim 14, wherein a projecting amount of the sheet from the downstream end of the mount is shorter than a projecting amount of the first guide from the downstream end of the mount and is longer than a projecting amount of the second guide from the downstream end.

17. The image forming apparatus according to claim 13, wherein a leading end of the sheet is inclined relative to the direction of delivery from one end to the other end of the sheet in the lateral direction.

18. The image forming apparatus according to claim 13, wherein a leading end of the sheet is perpendicular to the direction of delivery.

19. The image forming apparatus according to claim 1, wherein the second guide has a shape of approaching the first guide toward the leading end of the second guide.

20. The image forming apparatus according to claim 1, further comprising a conductive base on which the first guide is joined to project beyond the base toward the transfer section; and a conductive member disposed within a joined face of the first guide with the base.

21. The image forming apparatus according to claim 20, wherein the conductive member is a conductive double-sided adhesive tape.

22. The image forming apparatus according to claim 20, wherein the conductive member is made of one of polycarbonate and polyethyleneterephthalate.

23. An image forming apparatus, comprising:

an image bearer to bear an image;

a transferer to transfer the image from the image bearer onto a recording medium at a transfer section between the transferer and the image bearer;

a first guide disposed upstream from the transfer section in a direction of delivery of the recording medium, to guide the recording medium;

a second guide disposed upstream from the first guide in the direction of delivery of the recording medium and spaced away from the first guide, to guide the recording medium, the second guide including one end and the other end in a lateral direction perpendicular to the direction of delivery of the recording medium; and a mount to mount the second guide, wherein a projecting amount of the other end of the second guide from the mount is greater than a projecting amount of one end of the second guide from the mount; and the first guide and the second guide are disposed on a same side as the image bearer relative to a delivery path of the recording medium.

24. The image forming apparatus according to claim 23, further comprising a sheet attached on a back face of the first guide and disposed between the first guide and the second guide.

25. The image forming apparatus according to claim 23, wherein the second guide is made of resin.

26. The image foiling apparatus according to claim 25, wherein the second guide includes a plurality of resin films.

27. The image forming apparatus according to claim 26, wherein the plurality of resin films are laminated.

28. The image forming apparatus according to claim 23, wherein the first guide is mounted to the mount, the first guide includes one end and the other end in the lateral direction perpendicular to the direction of delivery of the recording medium, and a projecting amount of the other end of the first guide from the mount is equal to a projecting amount of one end of the first guide from the mount.

29. The image forming apparatus according to claim 23, wherein the first guide is mounted to the mount, the first guide includes one end and the other end in the lateral direction perpendicular to the direction of delivery of the recording medium, and a projecting amount of the other end of the first guide from the mount is greater than a projecting amount of one end of the first guide from the mount.

30. The image forming apparatus according to claim 29, wherein a difference, between the projecting amount of the other end of the first guide from the mount and the projecting amount of one end of the first guide from the mount, is smaller than a difference between the projecting amount of the other end of the second guide from the mount and the projecting amount of one end of the second guide from the mount.

31. The image forming apparatus according to claim 29, wherein a leading end of the first guide is parallel to a leading end of the second guide.

* * * * *